US006722762B2

(12) United States Patent
Miyazawa et al.

(10) Patent No.: US 6,722,762 B2
(45) Date of Patent: Apr. 20, 2004

(54) INK-JET RECORDING DEVICE AND INK CARTRIDGE

(75) Inventors: Hisashi Miyazawa, Nagano (JP); Satoshi Shinada, Nagano (JP); Yasuto Sakai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/045,933

(22) Filed: Oct. 19, 2001

(65) Prior Publication Data

US 2002/0154200 A1 Oct. 24, 2002

(30) Foreign Application Priority Data

| | | |
|---|---|---|
| Oct. 20, 2000 | (JP) | P2000-320319 |
| Oct. 20, 2000 | (JP) | P2000-321207 |
| Feb. 9, 2001 | (JP) | P2001-033074 |
| Apr. 3, 2001 | (JP) | 2001-104526 |
| May 17, 2001 | (JP) | P2001-147418 |
| May 18, 2001 | (JP) | P2001-149315 |
| Aug. 31, 2001 | (JP) | P2001-264896 |

(51) Int. Cl.[7] ..... B41J 2/175
(52) U.S. Cl. ..... 347/86; 347/49
(58) Field of Search ..... 347/49, 86, 87

(56) References Cited

U.S. PATENT DOCUMENTS

| | | | | |
|---|---|---|---|---|
| 4,853,708 A | | 8/1989 | Walters | 346/75 |
| 5,519,422 A | * | 5/1996 | Thoman et al. | 347/49 |
| 5,617,128 A | | 4/1997 | Thoman et al. | 347/87 |
| 6,032,010 A | | 2/2000 | Kim et al. | 399/238 |
| 6,290,346 B1 | * | 9/2001 | Santhanam et al. | 347/86 |

FOREIGN PATENT DOCUMENTS

| | | | |
|---|---|---|---|
| EP | 0 903 236 A2 | 9/1998 | B41J/2/175 |
| EP | 0 903 236 A2 | 3/1999 | B41J/2/175 |

OTHER PUBLICATIONS

English translation of Taiwanese Office Action previously submitted on Nov. 7, 2002, in corresponding Taiwanese application No. 090125904.

* cited by examiner

*Primary Examiner*—Anh T. N. Vo
(74) *Attorney, Agent, or Firm*—Stroock & Stroock & Lavan LLP

(57) ABSTRACT

A recessed portion is formed in an ink cartridge 1 to define a three-dimensional space. Each of axes in the three-dimensional space containing one side surface of the ink cartridge in which an ink supply port 14 is formed is divided into a plurality of sections to obtain a plurality of coordinate points. Identification protruded portions 31-1 to 31-3 which serve as identification pieces are disposed selectively at the coordinate points in accordance with identification items.

40 Claims, 29 Drawing Sheets

INK-JET RECORDING DEVICE AND INK CARTRIDGE

BACKGROUND OF THE INVENTION

The present invention relates to a technique for identifying an ink cartridge which supplies ink at an appropriate negative pressure to a recording head which ejects ink droplets in response to print signals.

An ink-jet recording device is usually configured so that an ink-jet recording head for ejecting ink droplets in response to print signals is mounted on a carriage which makes reciprocating motion in a direction of the width of a recording sheet, and so that ink is supplied from an external ink tank to the recording head. In the recording head of a small-size type, an ink storage container such as an ink tank or the like is detachably attached to the carriage. On the other hand, in the recording head of a large-size type, the ink storage container is set on a frame or casing of the recording device, and connected to the recording head through an ink supply tube.

The ink tank mounted on the carriage is usually configured so that a porous member such as a sponge or the like is contained in the ink tank and impregnated with ink in order to reduce the change of pressure stemming from waving of ink or the like caused due to the reciprocating motion of the carriage.

Even in the case where the recording head is supplied with ink from a large-capacity ink bag, set on the frame, through the ink supply tube, ink is supplied to the recording head through a sub-tank having a damping function for preventing the change of ink pressure due to the motion of the carriage, in order to prevent the change of ink pressure from being caused by the bending of the tube due to the reciprocating motion of the carriage.

Hence, the former has a problem that the size or weight of the ink tank is increased by the volume of the porous member contained in the ink tank in comparison with the volume of ink capable of being contained in the ink tank. The latter has a problem that the recording device is complicated in structure because a mechanism is required for preventing the change of ink pressure owing to vibration.

Both recording head and ink have been further improved for the purpose of improving print quality, and ink-adapted to the recording head is designated by the maker.

On the other hand, because the ink cartridge is formed as a rectangular parallelepiped container from the point of view of the structure, or the like, of the recording device, there is a problem that the ink cartridge adapted to the recording device can be hardly identified and may be selected by mistake.

To solve the problem, protruded portions are formed in an ink cartridge holder of the recording device, and recessed portions are formed in the ink cartridge so as to be adapted to the protruded portions. That is, an ink supply needle passes through an ink supply port only when the protruded portions fit into the recessed portions.

If the weight of the ink cartridge, that is, the capacity thereof is reduced to make high-speed printing possible, there is however a problem that the number of kinds of recessed portions allowed to be formed in the narrow bottom portion of the ink cartridge is limited.

SUMMARY OF THE INVENTION

The present invention is based on this problem, and an object of the invention is to provide an ink-jet recording device in which the number of kinds of shapes for judgment of adaptability can be increased by use of a relatively narrow space, and to provide an ink cartridge adapted to the ink-jet recording device.

To achieve the foregoing object, the present invention provide, for example, an ink-jet recording device for supplying ink to a recording head from an ink cartridge provided with an ink supply port, wherein: each of three-dimensional space axes is divided into a plurality of sections to provide a plurality of coordinate points, and identification members protruded in a direction of insertion of the ink cartridge are formed to reach the coordinate points selected in accordance with identification items.

The present invention also provides, for example, an ink cartridge having a container provided with an ink supply port in one of side surfaces of the container and containing ink, and identification fitting portions formed in the one side surface so as to correspond to the identification members of a recording device for receiving the cartridge, wherein; each of three-dimensional space axes containing the one side surface is divided into a plurality of sections to obtain a plurality of coordinate points; and the identification fitting portions are disposed at the coordinate points selected in accordance with identification items so that the identification fitting portions are located to abut on end portions of the identification members.

Because a space is used three-dimensionally so that identification pieces are disposed in the space, the number of combinations is increased.

The present disclosure relates to the subject matter contained in Japanese patent application Nos.:

2001-033074. (filed on Feb. 9, 2001);

2001-147418 (filed on May 17, 2001);

2001-149315 (filed on May 18, 2001);

2001-264896 (filed on Aug. 31, 2001);

2000-321207 (filed on Oct. 20, 2000); and 2000-320319 (filed on Oct. 20, 2000), which are expressly incorporated herein by reference in their entireties.

DESCRIPTION OF THE PREFERRED EMBODIMENT

Figure 1A:
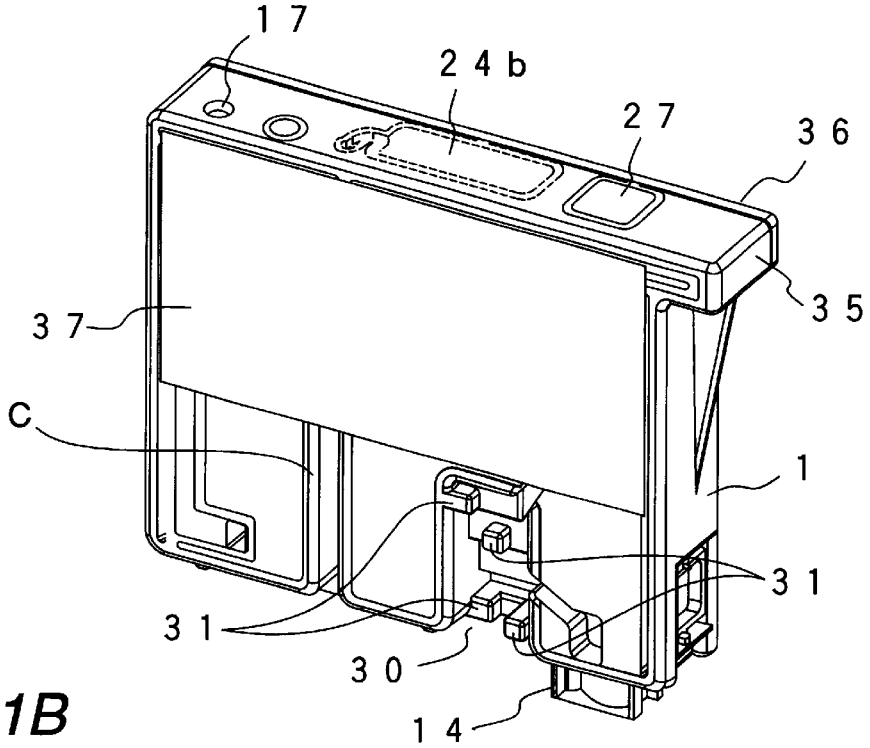
FIGS. 1A and 1B are views showing the front and rear structures of an ink cartridge according to one exemplary embodiment of the present invention

The present invention will be described below in detail on the basis of various exemplary embodiments shown in the drawings.

Figure 1B:
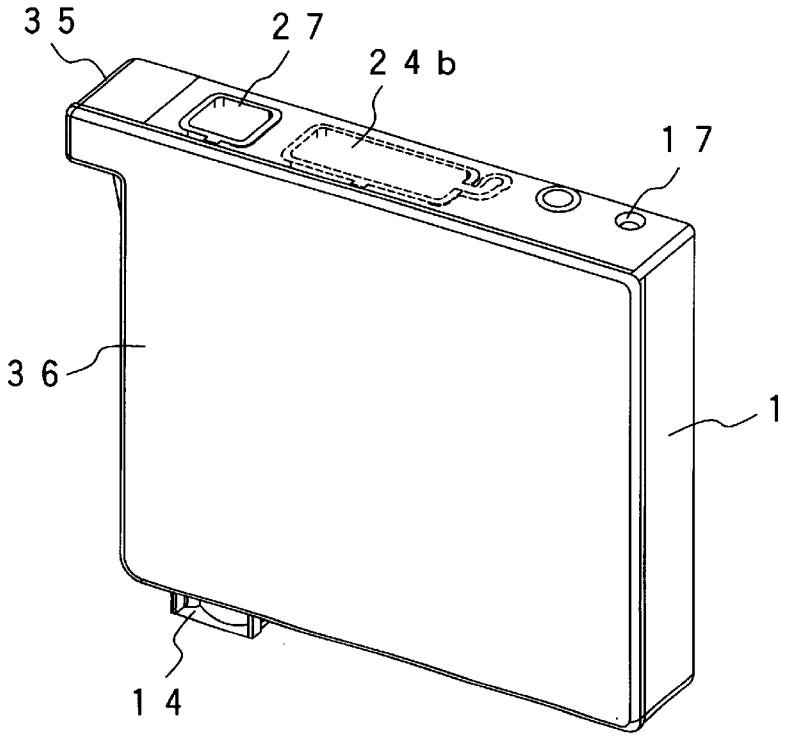
Figure 2A:
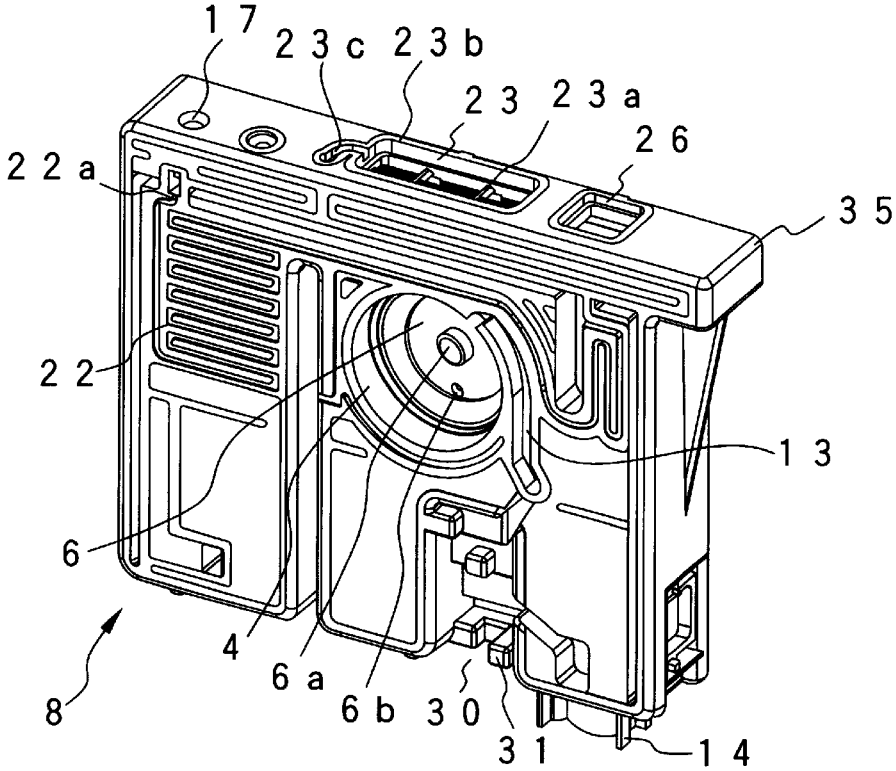
FIGS. 2A and 2B are views showing a state in which side surface-forming members for sealing the ink cartridge of FIG. 1 are removed.
Figure 2B:
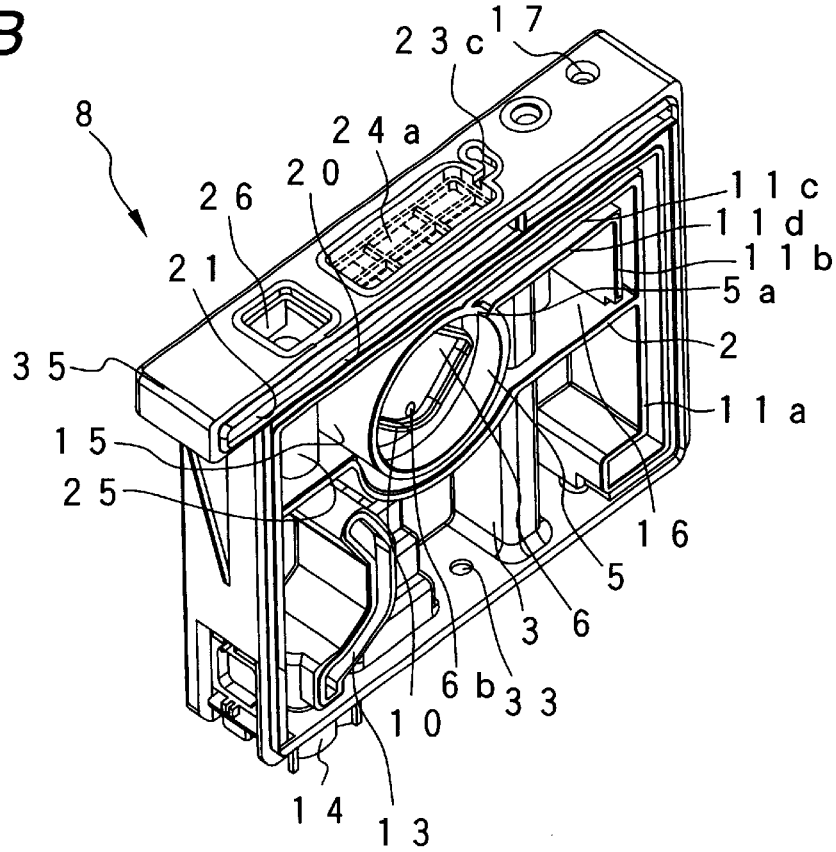
Figure 3:
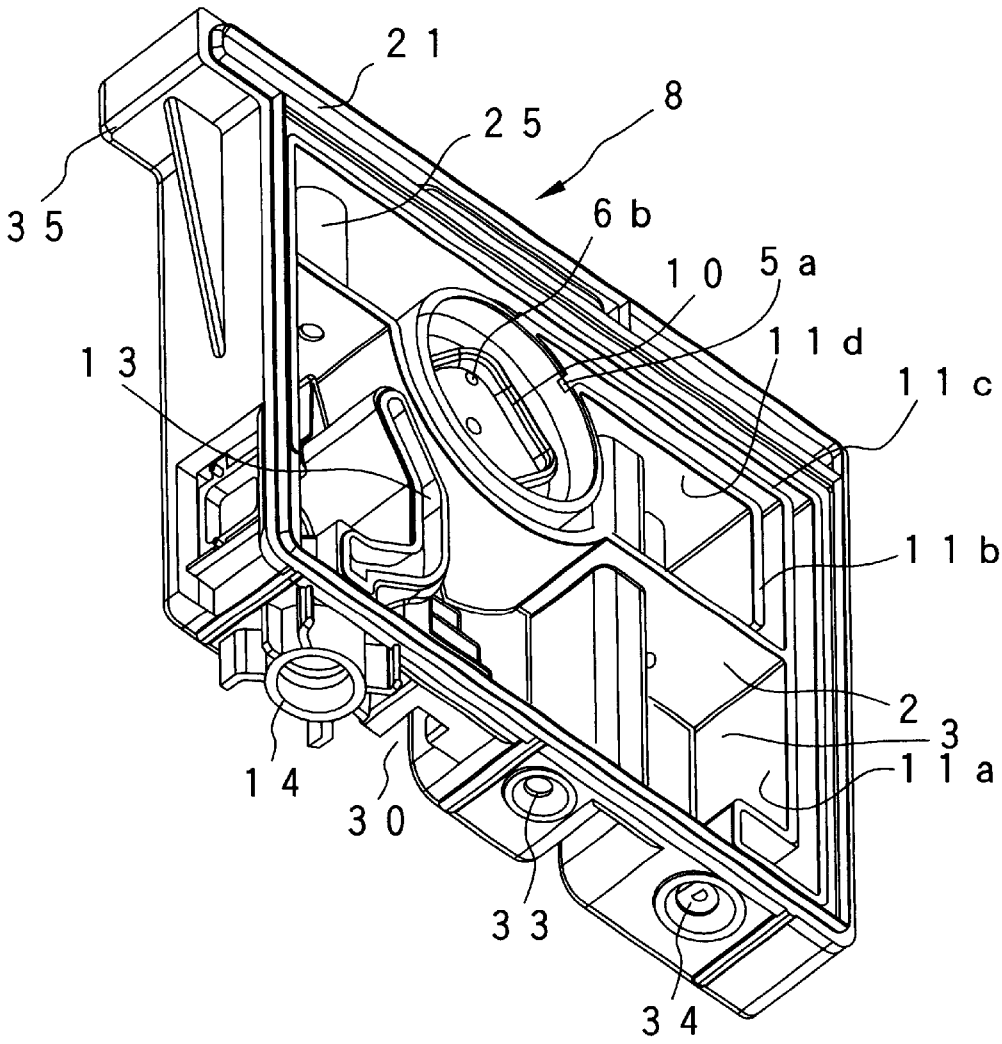
FIG. 3 is a view showing the structure of the bottom surface of the ink cartridge of FIG. 1.

FIGS. 1A and 1B show an ink cartridge 1 according to one embodiment of the present invention. FIGS. 2A and 2B show the front and rear structures of a container body 8 constituting the ink cartridge 1. FIG. 3 shows the structure of the container body 8 viewed from the bottom surface thereof. The container body 8 is partitioned into upper and lower regions by a wall 2 (FIG. 23) extended substantially horizontally. A first ink chamber 3 is formed in the lower region. A differential pressure valve-storing chamber 4 (FIG. 2A) which serves as a negative pressure generating mechanism which will be described later, a filter chamber 5 for storing a filter, and second and third ink chambers 15 and 16 are formed in the upper region.

The differential pressure valve-storing chamber 4 and the filter chamber 5 are separated from each other in a direction of the thickness of the container body 8 by a wall 6. A valve seat 6*a* (FIG. 2A) constituted by a protruded portion is formed on the differential pressure valve-storing chamber side of the wall 6, and through-holes 6*b* are formed through the wall 6. A frame 10 (FIG. 2B) for fixing a filter 18 is formed on the filter chamber side of the wall 6.

As shown in FIG. 2B. The upper and lower chambers are communicated with an upper region opening 5*a* of the filter chamber 5 via a circuitous flow passage (a flow passage turning on and along a vertical plane) defined by walls 11*a* and 11*b* extending vertically and walls 11*c* and 11*d* extended horizontally on one side portion of the ink cartridge (See also FIG. 7).

On the other hand, the differential pressure valve-storing chamber 4 connected to the filter chamber 5 by through-holes 6*b* is communicated with an ink supply port 14 by a flow path 13 which is formed so, as to be isolated from the first ink chamber 3. The ink chambers 15 and 16 are disposed so that the differential pressure valve-storing chamber 4 and the filter chamber 5 are put between the ink chambers 15 and 16. Air bubbles contained in ink ascending from the first ink chamber 3 are trapped in the ink chambers 15 and 16.

A wall 20 extends horizontally such that a slight gap is formed between the wall 20 and the outer wall of the container body 8 to define a space or air flow passage 21. The wall 20 is formed in the upper portion of the container body 8. The flowpassage (i.e. the space or air flowpassage) 21 is communicated with an air-opening port 17 through an air-permeable film 24*a* and a capillary 22 (FIG. 2A). The flow passage 21 is also communicated with the first ink chamber 3 through a cylindrical portion 25. That is, the first ink chamber 3 is connected to the air-opening port 17 through the cylindrical portion 25, the air-permeable film 24*a* and the capillary 22.

A meandering groove formed in the differential pressure valve-storing chamber (4) side surface of the container body is sealed with an air-impermeable film (FIG. 1A) 37 to thereby form the capillary 22. The capillary 22 has one end 22*a* connected to the air-opening port 17, and the other end communicated, through a groove 23*c*, with a region formed between the air-permeable film 24*a* and the air-impermeable film 24*b*. The air-permeable film 24*a*extends in the middle of the depth of a recessed portion 23 formed in the container body 8. Specifically, a film support portion 23*a* (FIG. 2A) is formed in the middle portion of the recessed portion 23 so that the air-permeable film 24*a* is bonded onto the film support portion 23*a* in a stretched state. On the other hand, an air-impermeable film 24*b* (FIGS. 1A and 1B) is bonded onto the upper surface 23*b* of the recessed portion 23 in a stretched state, so that air inside the container body 8 is insulated from atmosphere at this portion.

The flowpassage 21 is communicated with the first ink chamber 3 through the cylindrical portion 25. An opening 26 is provided above the upper portion of the cylindrical portion 25 and sealed with an air-impermeable film 27 (FIGS. 1A and 1B) which can be deformed elastically. Further, a normally closed type valve not shown is received in the cylindrical portion 25.

In this configuration, the film 27 is elastically deformed by an operating rod which comes in to contact with the same when the ink cartridge 1 is attached to the recording device, so that the valve is opened. As a result, the first ink chamber 3 is put in communication with the flow passage 21.

As shown in FIGS. 2A and 3, a recessed portion 30 is formed just below the differential pressure valve-storing chamber 4, and opened to the lower surface side in which the ink supply port 14 is provided. Identification protruded portions 31 for identifying the ink cartridge are formed in the recessed portion 30. Ink injection ports 33 and 34 for charging ink at the time of manufacture of the ink cartridge are also formed in the lower surface of the container body 8.

Figure 4:
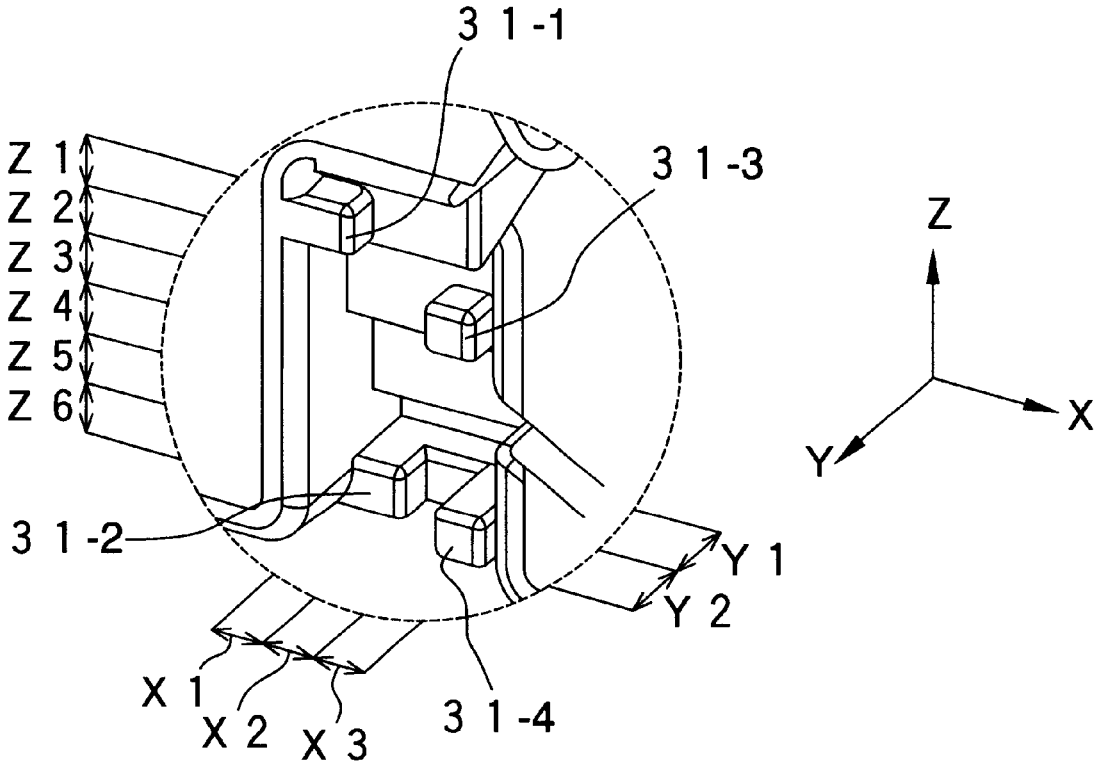
FIG. 4 is an enlarged explanatory view showing the insertion error prevention-forming region formed in the ink cartridge of FIG. 1.

As shown in FIG. 4, in the recessed portion 30, the direction X of the length of the container is divided into three, the direction Y of the width of the container is divided into two, and the direction Z of the height of the container is divided into six to thereby form coordinate points. A plurality of identification protruded portions 31-1, 31-2, 31-3 and 31-4 are disposed at coordinate points (X1, Y2, Z1), (X1, Y1, Z6), (X3, Y2, Z3) and (X3, Y1, Y2, Z5), respectively, by selecting an appropriate combination from the coordinate points, to thereby constitute the identification fitting portions. It is a matter of course that when the coordinate points are set and selected to correspond one-by-one to, for example, a kind of ink cartridge and/or a kind of ink, an ink cartridge different in the kind of ink can be prevented from being attached to the recording device by mistake.

Figure 5A:
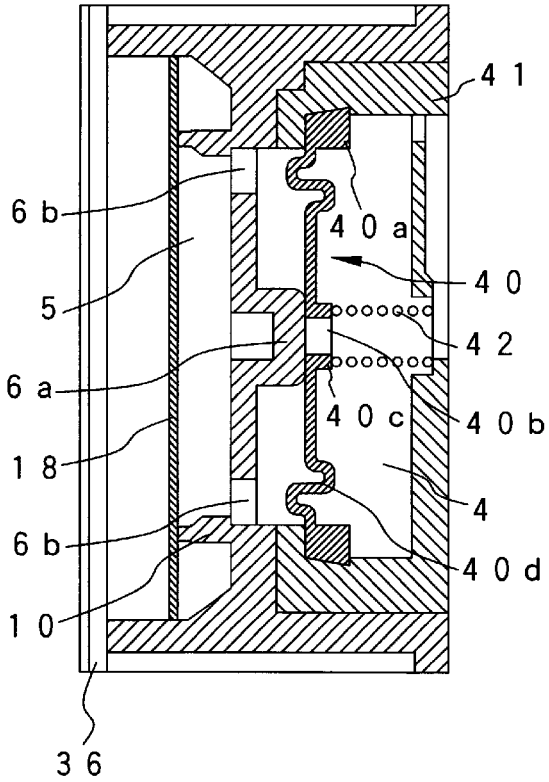
FIG. 5A is a sectional view showing a valve-closed state in an embodiment of the differential pressure valve constituting a negative pressure generating mechanism.
Figure 5B:
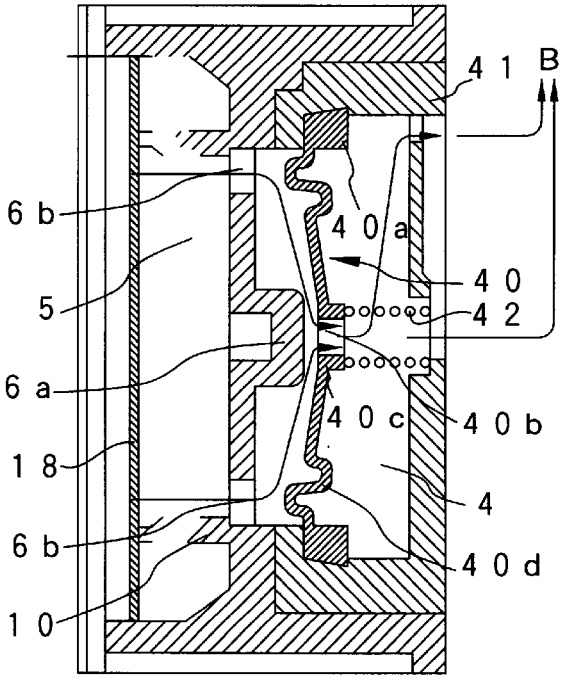
FIG. 5B is a sectional view showing a valve-opened state in the embodiment of the differential pressure valve.

FIGS. 5A and 5B show an example of the differential pressure valve serving as a negative pressure generating mechanism. FIG. 5A shows a state in which the valve is closed. FIG. 5B shows a state in which the valve is opened. A membrane valve 40 has an annular thick portion 40*a* in its outer circumference, a thick portion 40*c* provided with a through-hole 40*b* in its center, and an approximately S-shaped bent portion 40*d* provided near the thick portion 40*a*. The membrane valve 40 is fixed to a cylindrical holder 41, which is fitted into the differential pressure valve-storing chamber 4. A coiled spring 42 is inserted into between the center thick portion 40*c* and the container body 8 (in this embodiment, between the center thick portion 40*c* and the cylindrical holder 41). The elastic force of the coiled spring 42 is adjusted so that the membrane valve 40 can be separated from the valve seat 6*a* at the point of time when a predetermined negative pressure due to ink consumption in the recording head acts on the ink supply port 14 (FIG. 5B), and the membrane valve 40 can be made to contact the valve seat 6*a* elastically at the point of time when the ink supply to the recording head is terminated (FIG. 5A).

The container body 8 configured as described above is formed into a sealed container by sealing the filter chamber side surface thereof with a cover 36 (FIG. 1B) and by sticking the air-impermeable film 37 (FIG. 1A) onto the differential pressure chamber side surface thereof. In the condition that the ink supply port 14 is sealed with a film which can be broken by insertion of an ink supply needle, an ink injection device is connected to the ink injection ports 33 and 34 in the bottom surface and the sealed container is filled with ink. After the sealed container is filled with ink; the ink injection ports 33 and 34 are sealed with a plug(s) or an air-impermeable film(s). Thus, the sealed container is finished as an ink cartridge 1.

Figure 6A:
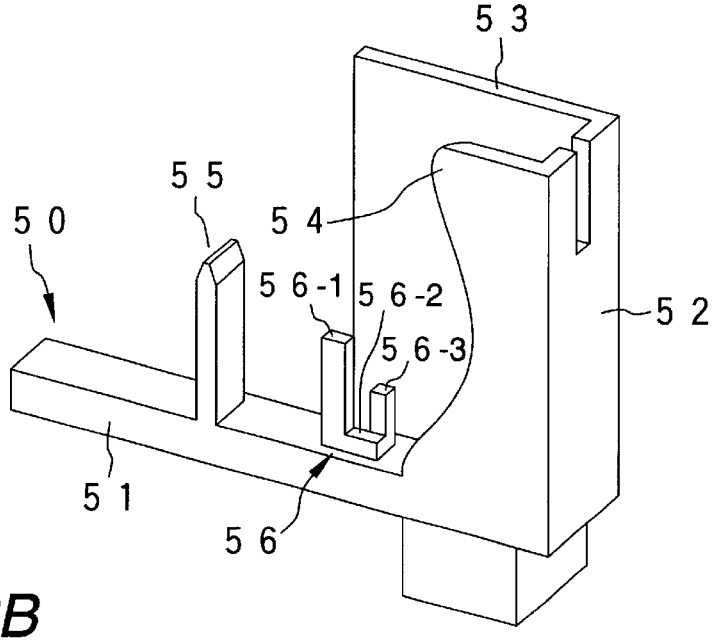
FIG. 6A is a partly cutaway view showing an ink cartridge holder adapted to the ink cartridge of FIG. 1.

FIG. 6A shows an example of a cartridge holder 50 adapted to the aforementioned ink cartridge 1. The cartridge holder 50 has a base portion 51, walls 52, 53 and 54 provided on the base portion 51 so as to correspond to the front surface of the ink cartridge and the two side surfaces thereof adjacent to the front surface, a protruded portion (or identification fitting portion) 55 provided on the base portion 51 and located in position corresponding to a vertical recessed portion of the ink cartridge, and identification pieces (or identification members) 56 extending in an insertion/removal direction of the ink cartridge for detecting the kind of the ink cartridge.

Specifically, the identification pieces 56 are constituted by a plurality of pieces 56-1, 56-2 and 56-3 which are selected to have lengths to reach the lower surfaces of the identification protruded portions 31-1, 31-2, 31-3 and 31-4 formed in the recessed portion 30 of the ink cartridge from the surface of the carriage, that is, to have sizes to prevent collision of the identification pieces 56 with the idenitification protruded portions 31-1, 31-2, 31-3 and 31-4 which are identification fitting portions, when an adapted ink cartridge is received.

Hence, when the ink cartridge adapted to the carriage (the holder 50) is to be attached to the holder 50, the identification pieces 56 allow the ink cartridge to be fitted to the holder 50. On the contrary, when an incompatible ink cartridge is to be attached to the holder 50, the identification pieces 56 of the carriage (the holder 50) cooperate with the identification protruded portions 31 of the cartridge to prevent the ink supply needle from moving more into the ink supply port 14. In addition, an ink supply needle is not illustrated in FIGS. 6A and 6B, but the ink supply needle is provided on the base portion 51 of the holder 50 and located in a region surrounded by the walls 52, 53 and 54, i.e. in a region opposite the protruded portion 55 with respect to the identification pieces 56.

Figure 6B:
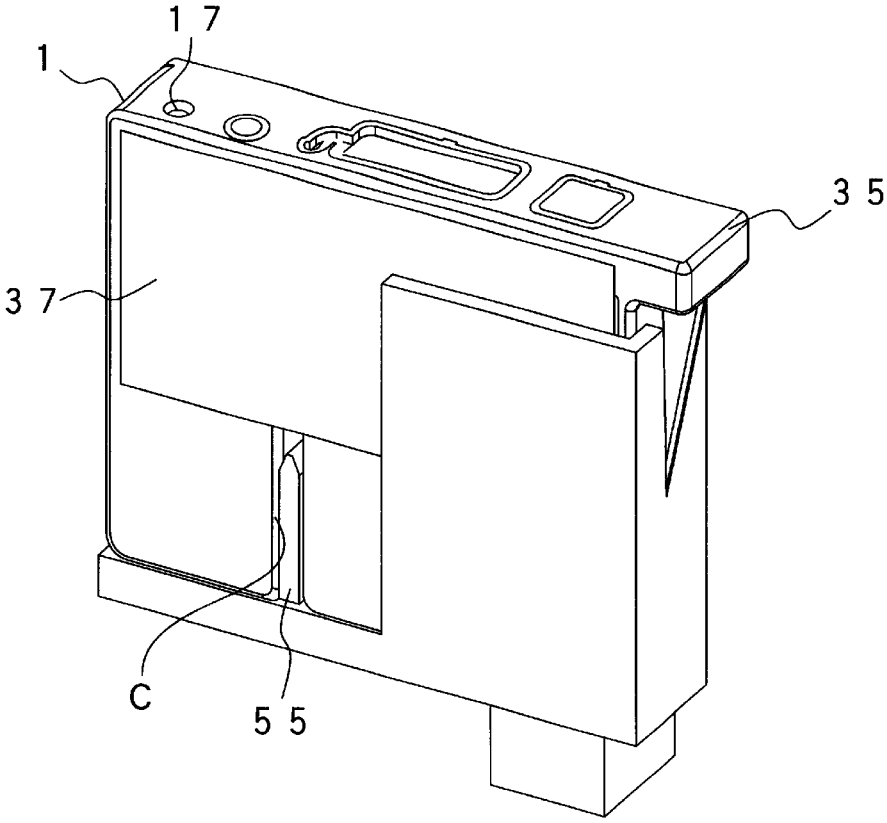
FIG. 6B is a view showing a state in which the ink cartridge is attached.

In this embodiment, when the ink cartridge 1 is attached to the ink cartridge holder 50, the front side three surfaces of the ink cartridge 1 and the recessed portion C (FIG. 6B) of the ink cartridge 1 are guided by the walls 52, 53 and 54 and the protruded portion 55 respectively so that the ink cartridge 1 is positioned to a predetermined location as shown in FIG. 6B. Further, the film 27 is pressed by the operating rod (not shown) of the recording device to open the valve member installed in the cylindrical portion 25. Hence, the first ink chamber 3 is opened to the air through the flow passage 21, the air permeable seal 24*a*, the capillary 22, etc.

When ink is consumed by the recording head in this condition so that negative pressure acts on the ink supply port 14, the membrane valve 40 receives differential pressure and is separated from the valve seat 6*a* against the urging force of the coiled spring 42. The ink in the first ink chamber 3 passes through the filter 18 and flows through the through-holes 6*b* into the differential pressure valve-storing chamber 4. The ink further passes through the through-hole

40*b* of the membrane valve 40 and flows into the ink supply port 14 via the flow passage 13.

Figure 7:
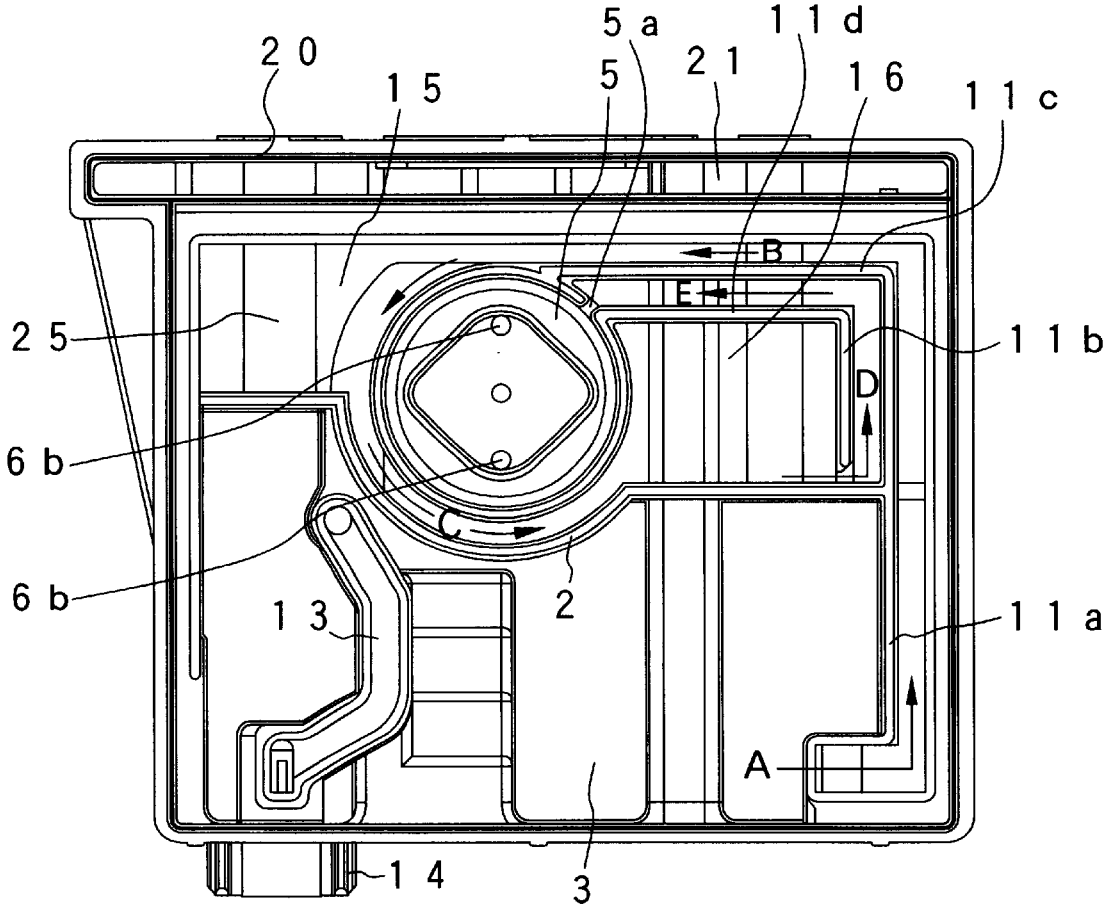
FIG. 7 is a front view mainly showing the filter chamber side ink flow path formed in the ink cartridge of FIG. 1.

As shown in FIG. 7, when ink flows out of the ink supply port 14 so that negative pressure acts on the filter chamber 5, ink in the first ink chamber 3 is sucked into the upper region of the filter chamber 5 via a flow passage A formed by the wall 11 so as to extend substantially vertically, a flow passage 8 extending horizontally in the uppermost portion, a flow passage C formed by the wall forming the filter chamber 5 and the wall 2 extending horizontally, a vertical flow passage D and a horizontal flow path E. In this manner, the ink in the first ink chamber 3 flows out of the bottom portion of the first ink chamber 3 via the two ink chambers 15 and 16. Hence, air bubbles contained in the ink are trapped (i.e. stay) in the upper portions of the ink chambers 15 and 16, and are removed from the ink as much as possible before the ink flows into the filter chamber 5.

When ink is consumed in the aforementioned manner, ink in the first ink chamber 3 located in the lower section is sucked up to the filter chamber 5 located in the upper section, and is then supplied to the ink supply port 14 through the differential pressure valve mechanism.

When ink in the ink cartridge 1 is consumed and the ink cartridge 1 is removed because ink in the ink cartridge is consumed completely or because of exchange with a different kind of ink, the valve member in the cylindrical portion 25 for communication of the first ink chamber 3 with the flow passage 21 loses support by the operating rod of the recording device, so that the valve is closed. Further, the membrane valve 40 is urged to contact the valve seat 6*a* elastically by the spring 42. Consequently, ink is prevented from being leaked from the ink supply port 14.

Figure 8:
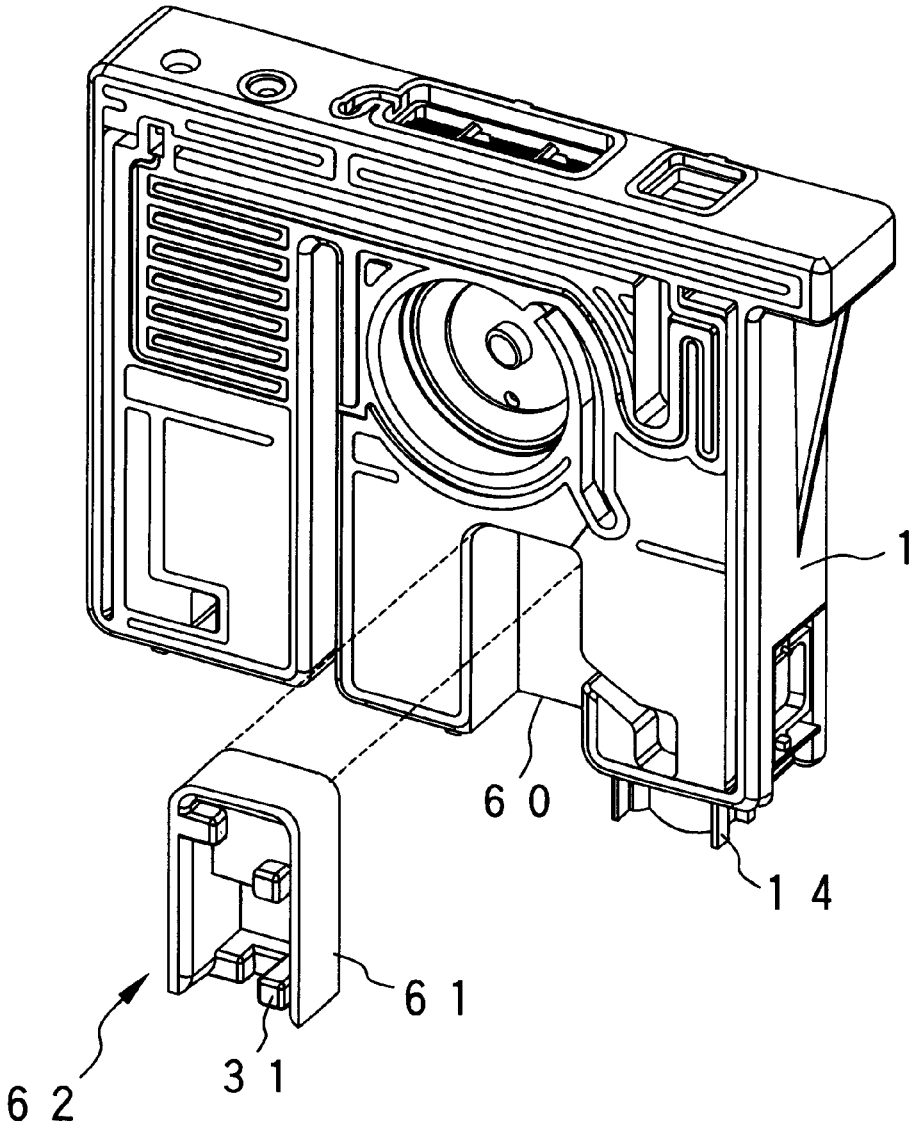
FIG. 8 is a view showing another embodiment of an ink cartridge according to the present invention.

In the aforementioned embodiment, identification protrusions are formed to be integrated with the ink cartridge. As shown in FIG. 8, alternatively, a recessed portion 60 may be formed in the container body 8 constituting the ink cartridge 1, and a frame 61 capable of being inserted and fixed to the inner circumference of the recessed portion 60 may be formed as a discrete member. Further, the identification protruded portions 31 maybe formed in the inner surface of the frame 61 so that the frame 61 forms an identification block 62.

According to this example of an ink cartridge according to the present invention, by preparing the identification blocks 62 having the identification protruded portions 31 different in positions in accordance with kinds of the ink cartridges 1, the container bodies 8 per se can be used commonly for various kinds of ink.

FIGS. 9A and 9B and FIGS. 10A to 10D show the external appearance of a further exemplary embodiment of an ink cartridge according to the present invention. The ink cartridge 71 mainly has a flat rectangular box type container body 72 having a closed side and an opposite opening side, and a cover 73 for sealing the opening side. An ink supply port 74 is provided on the leading end side in the direction of insertion of the ink cartridge into a carriage (i.e. on the bottom surface of the container body 72 in this embodiment), and is offset in the lengthwise direction. Retaining members 75 and 76 are formed on respective sides of the upper portion of the container body 72.

A memory device 77 with electrodes 77*a* is provided in a recessed portion 72*b* below the retaining member 75 located on the ink supply port side. A valve-storing chamber 78 is formed below the other retaining member 76. As lit portion 79, extending in the insertion/removal direction of the ink cartridge 71, is formed near the ink supply port 74 and in the center region of the container body 72.

Figure 11:
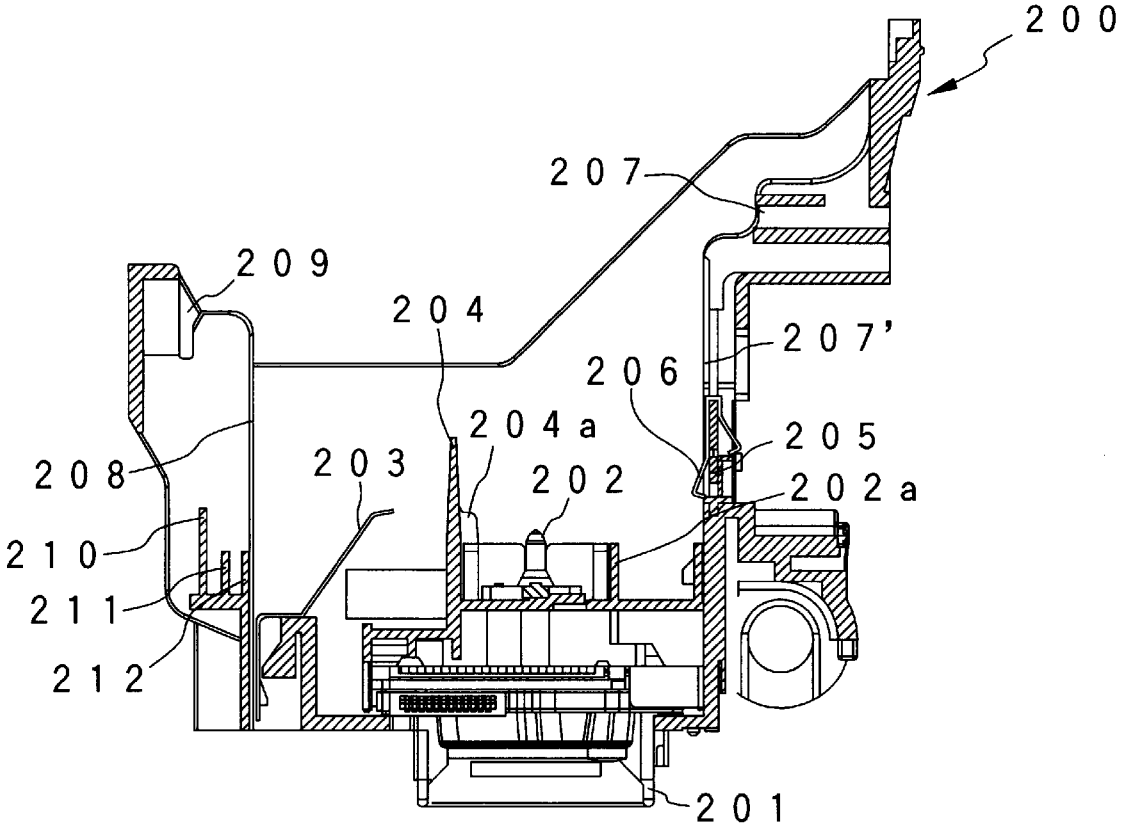
FIG. 11 is a sectional view showing an embodiment of the carriage to which the ink cartridge of FIG. 9 is attached.

As shown in FIG. 11, a carriage 200 to which the ink cartridge 71 is attached is configured so that a recording head 201 is provided in the bottom surface. An ink supply needle 202 is provided to the carriage 200 to be communicated with the recording head 201. A cartridge pressing member is provided in a region far from a region in which the ink supply needle 202 is provided. In this embodiment, a leaf spring or plate spring 203 is provided as the cartridge pressing member. A positioning protruded piece 204 is formed between the ink supply needle 202 and the leaf spring 203 to extend in the insertion/removal direction of the ink cartridge 71.

Electrodes 206 are disposed in a side wall 205 on the ink supply needle 202 side. A recessed portion 207 for engagement with the protrusion 75*a* of the retaining member 75 are formed above the electrodes 206. A recessed portion 209 for engagement with the protrusion 76*a* of the retaining member 76 of the ink cartridge 71 is formed in a side wall 208 opposite to the side wall 205.

Figure 12A:
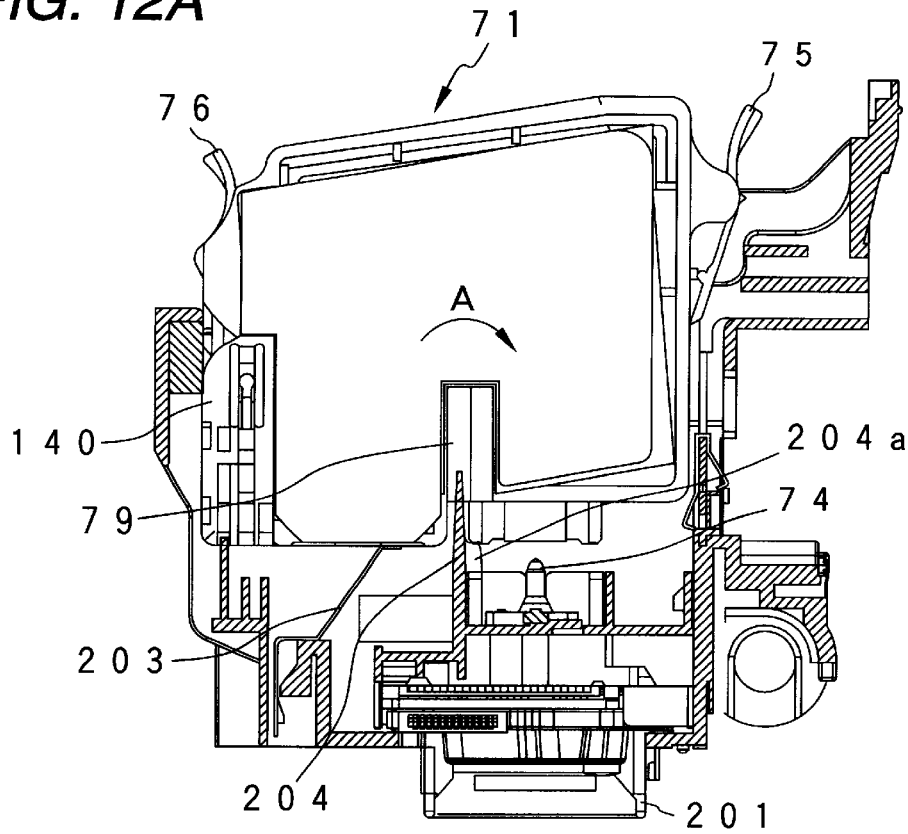
FIGS. 12A and 12B are views showing a process in which the ink cartridge is attached to the carriage of FIG. 9.

In the aforementioned structure employed, when the ink cartridge 71 is inserted with the ink supply port 74 located at the deep side and pushed against the plate spring 203 as shown in FIG. 12A, the slit portion 79 is restricted by the protruded piece 204*d*. Hence, even in the case where a rotating force (the arrow A in FIG. 12A) is given by the plate spring 203 provided an offset position so that the ink supply port 74 side is turned downward, the posture of the ink cartridge is restricted to be parallel with the specified insertion/removal direction, that is, in a direction parallel with the vertical direction in this embodiment.

Figure 12B:
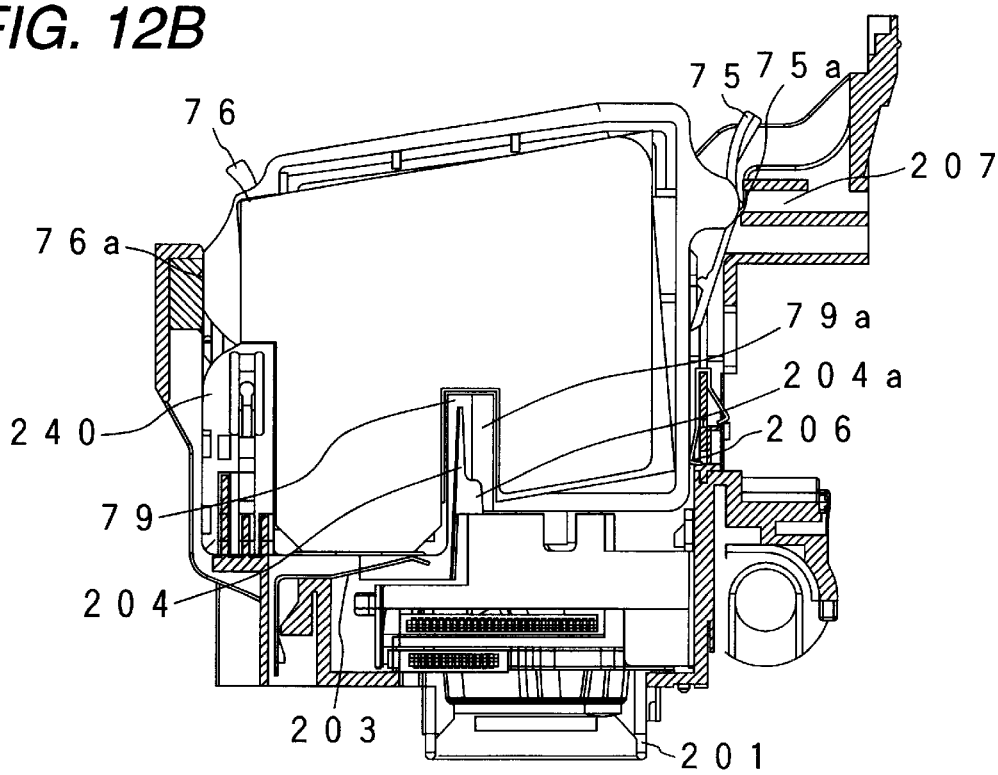

When the ink cartridge 71 is further pushed in against the urging force of the plate spring 203, the protrusion 75*a* of the retaining member 75 is dropped and fitted into the recessed portion 207 by the total elasticity of the retaining member 75 as shown in FIG. 12B. Also, the retaining member 76 is fitted into the recessed portion 209.

On the other hand, to remove the ink cartridge 71 from the carriage 200 for exchange or the like, when the retaining member 75 is pressed elastically toward the container body 72, the protrusion 75*a* of the retaining member 75 is separated from the recessed portion 207. Hence, when the ink cartridge 71 is pulled out in this condition, the ink cartridge 71 can be removed without bending force or the like acting on the ink supply needle 202.

Figure 13:
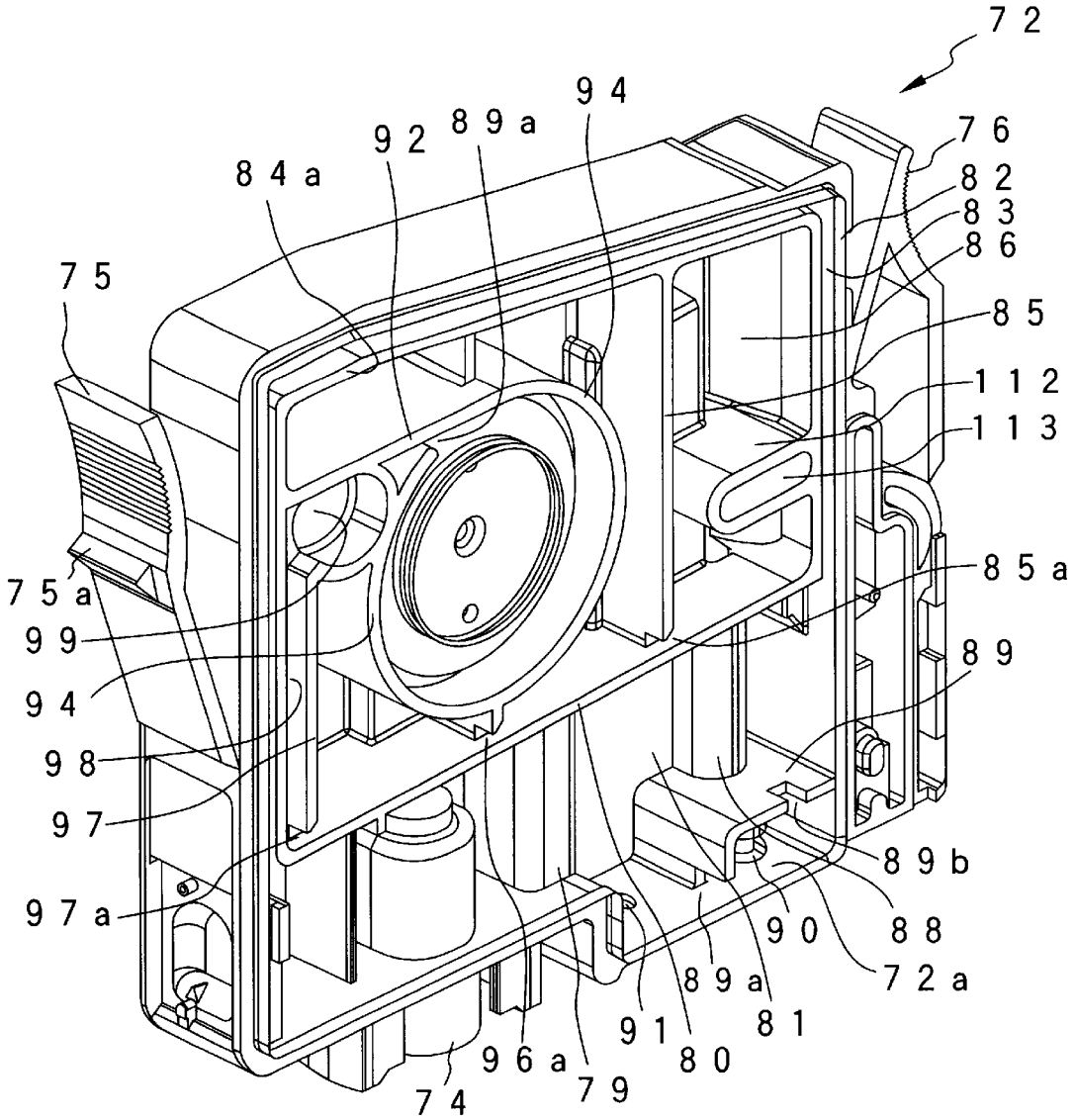
FIG. 13 is a perspective view showing the structure of the opening surface of the container body constituting the ink cartridge of FIG. 9.
Figure 14:
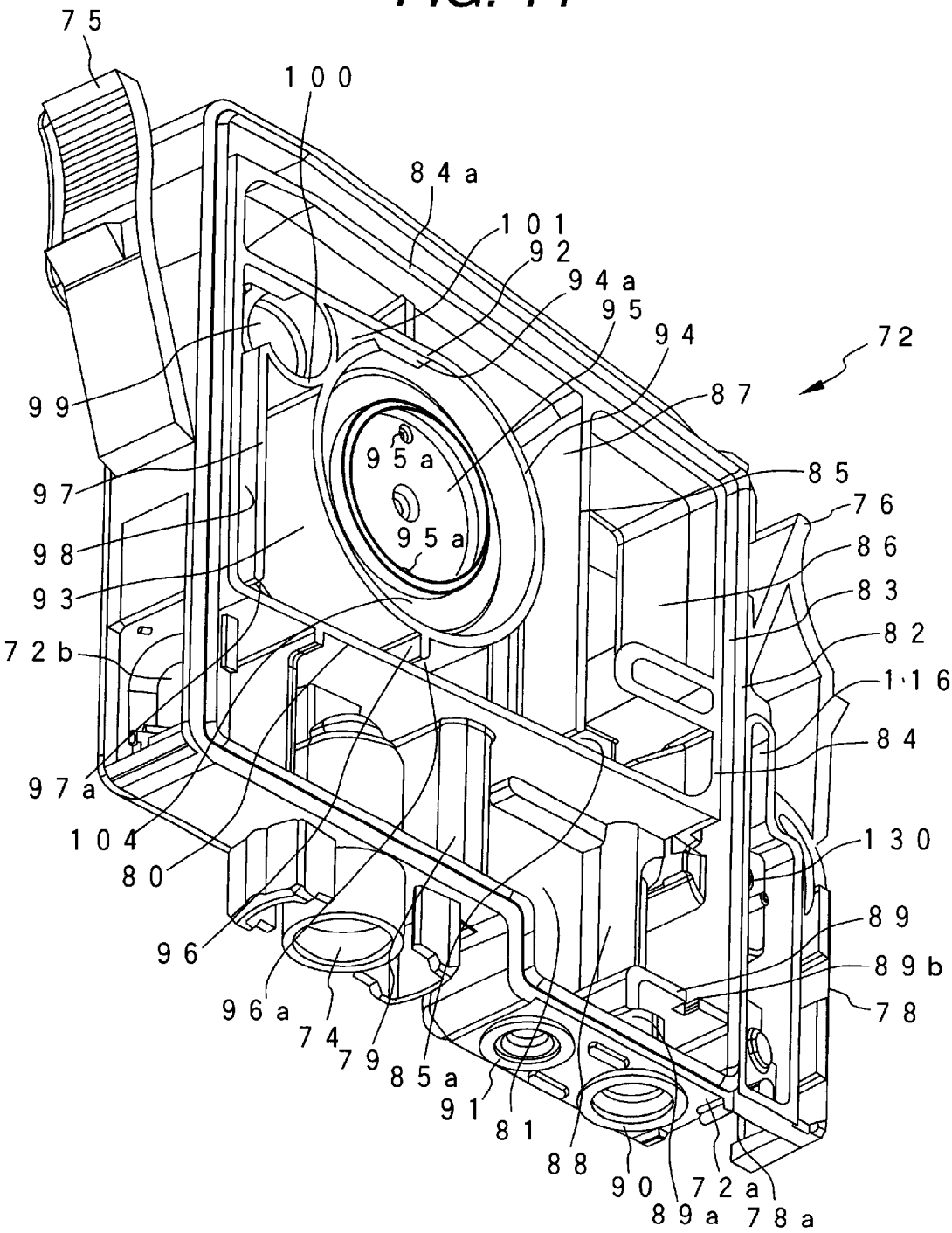
FIG. 14 is a perspective view showing the structure of the bottom surface of the container body constituting the ink cartridge.

FIGS. 13 and 14 show an example of a flow passage formed in the container body 72 constituting the ink cartridge 71. The container body 72 is partitioned into upper and lower sections by a wall 80 which extends substantially horizontally and, more specifically, extends in such a manner that the ink supply port 74 side is located slightly lower.

A first ink chamber 81 is formed in the lower section region. The upper section is partitioned by a frame 84 such that the wall 80 serves as a bottom surface and that the frame 84 is spaced at a predetermined space, gap or distance from a wall 82 of the container body 72 to define an air communication passage 83. The interior of the frame 84 is divided by a vertical wall 85 having a communication port 85*a* formed in its bottom portion, so that one region is formed as a second ink chamber 86 and the other region is formed as a third ink chamber 87.

The second ink chamber 86 and the bottom surface 72*a* of container body 72 are connected to each other by a suction flow passage 88 which has a lower end communicated with the first ink chamber 81, and an upper end communicated with the bottom portion of the second ink chamber 86.

A wall 89 having communication ports 89*a* and 89*b* is formed in the lower portion of the suction flow passage 88.

An opening 90 for injecting ink from the outside into the container body 72 and an opening 91 communicated with the first ink chamber 81 for discharging air at the time of injection of ink or injecting ink into the interior of the ink cartridge 71 are formed in a region opposite to the lower end of the suction flow passage 88.

The third ink chamber 87 is partitioned by a wall 92 at a predetermined gap from the upper surface 84*a* of the frame 84 and by walls 94, 96 and 85. A fourth ink chamber 93 is partitioned by walls 94, 96 and 97. A filter chamber 104 is partitioned by the wall 94 continuous to the wall 92 for storing a filter 125 (FIG. 16) and a differential pressure valve-storing chamber 103 (FIG. 15A) is partitioned on the other surface side opposite to the filter chamber 125 by a wall 95. Through-holes 95*a* are provided through the wall 95 so that ink passed through the filter 125 is led to the differential pressure valve-storing chamber 103. The filter chamber 104 and the differential pressure valve-storing chamber 103 are located opposite each other with respect to the common wall 95.

The partition wall 96 having the communication port 96*a* between the walls 80 and 96 is provided in the lower portion of the wall 94. The partition wall 97 having a communication port 97*a* in the lower portion is provided to define an ink flow passage 98 between the wall 97 and the frame 84. The upper portion of the ink flow passage 98 is communicated with the front surface side of the ink cartridge 71 through the through-hole 99.

The through-hole 99 is separated by a wall 100 continuous to the wall 97 as shown in FIG. 14, and is communicated via a recessed portion 100*a* (FIG. 15A) of the wall 100 with the upper portion of the filter chamber 104. In more detail, the through-hole 99 is communicated with a region 101 partitioned by the walls 100, 94 and 92 through the recessed portion 100*a* and is further communicated with the upper portion of the filter chamber 104 through the communication port 94*a* formed in the upper portion of the wall 94 for partitioning the filter chamber 104.

Figure 15A:
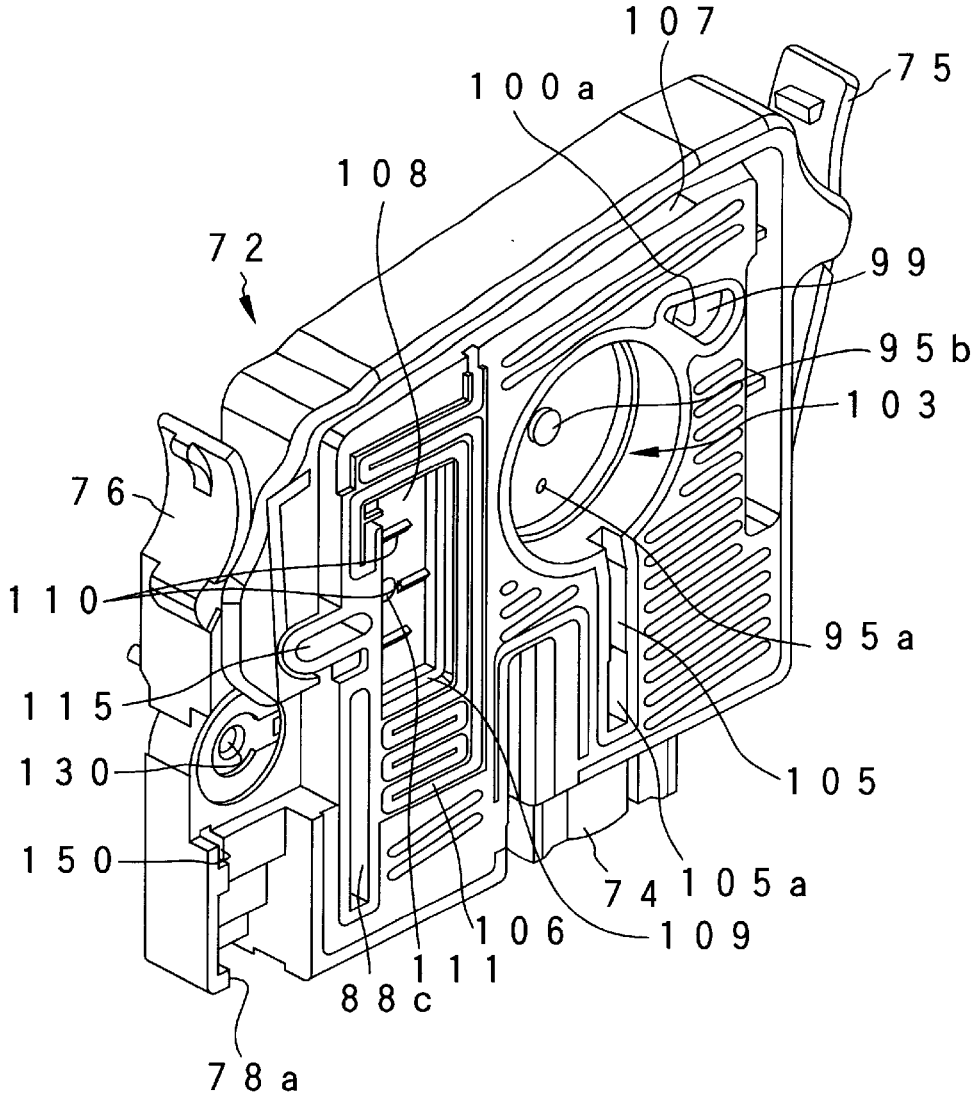
FIG. 15A is a perspective view showing the structure of the front surface of the container body constituting the ink cartridge of FIG. 9.

As shown in FIG. 15A, the lower portion of the differential pressure valve-storing chamber 103 and the ink supply port 74 are connected to each other by a flow passage constituted by a recessed portion 105 formed in a surface of the container body 72, and an air-impermeable film covering the recessed portion 105. In FIG. 15A, the reference numeral 105*a* designates a deep portion which comes into the ink supply port side.

Figure 15B:
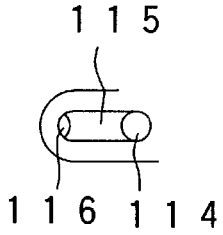
FIG. 15B is a view showing a through-hole formed in a communication groove.

A narrow groove 106 which meanders so that flow path resistance is made as high as possible, a wide groove 107 around the narrow groove 106, and a rectangular recessed portion 108 in a region opposite to the second ink chamber 86 are formed in the front surface of the container body 72. A frame 109 and ribs 110 are formed in the rectangular recessed portion 108 so as to be located in a position lowered by one step from an opening edge of the recessed portion 108. An air-permeable film having ink repellent property and air permeability is bonded to the frame 109 and the ribs 110 in a stretched state to thereby define an air communication chamber. The narrow groove 106 is communicated with a surface side region of the recessed portion 108 with respect to the air permeable film. A through-hole 111 is formed in the bottom surface of the recessed portion 108, and communicated with one end of a slender region 113 (FIG. 13) partitioned by a wall 112 of the second ink chamber 86. The other end of the slender region 113 is communicated via a through-hole 114, a communication groove 115 and a through-hole 116 with the valve-storing chamber 78 as shown in FIG. 15B.

At a leading end of the valve-storing chamber 78 in the insertion direction of the ink cartridge, i.e. at the lower portion of the valve-storing chamber 78 in this embodiment, a window 78*a* is formed and opened as shown in FIG. 14. An identification block 140 to be described later is mounted to a recessed portion 150 of the container body 72 so that the plural identification pieces 210, 211 and 212 (FIG. 11) and the valve-operating rod, which are provided on the carriage 200 of the recording device body, can enter through the window 78*a*.

Figure 16:
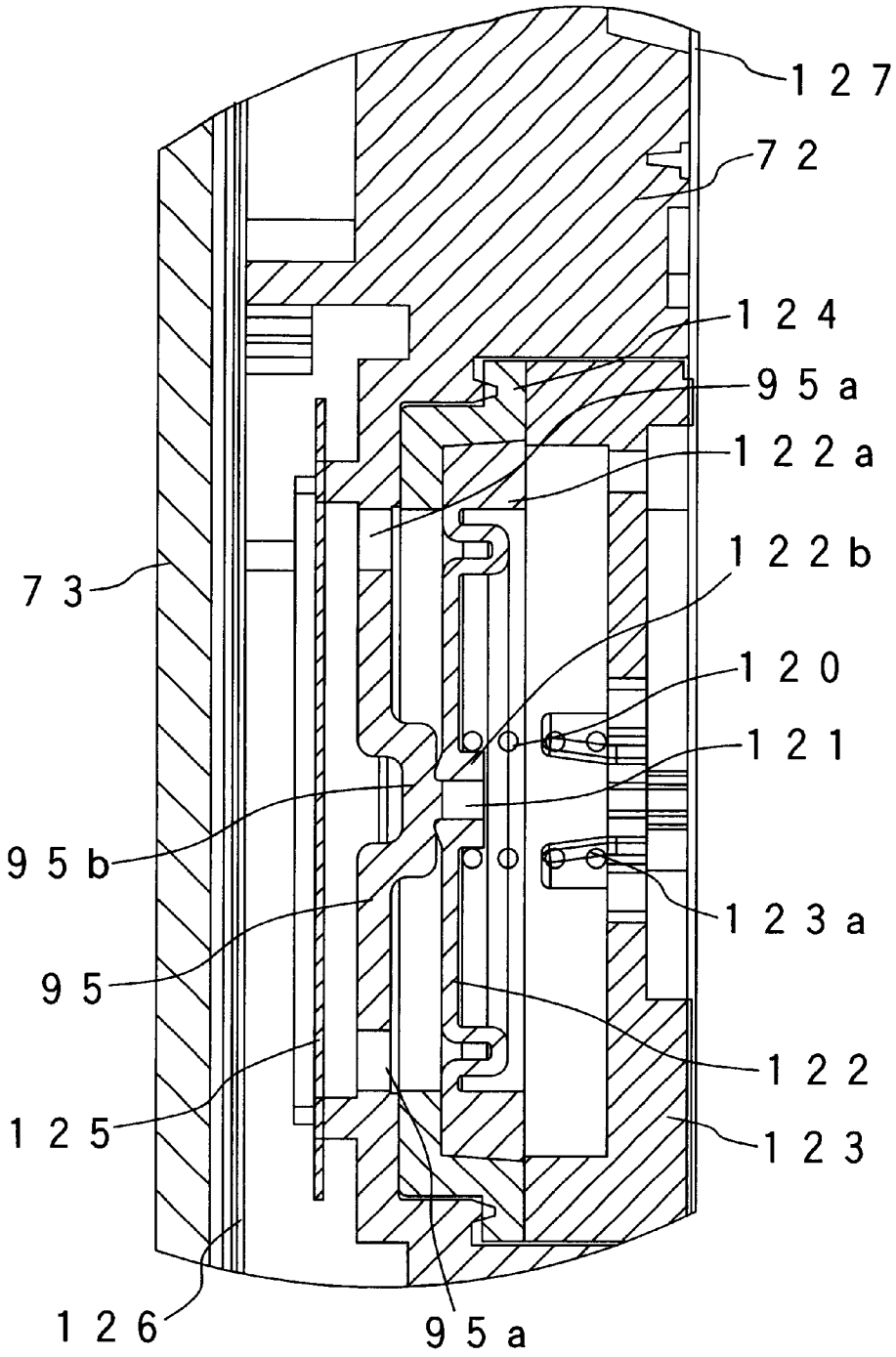
FIG. 16 is an enlarged view showing the sectional structure of the negative pressure generating mechanism-storing chamber.

FIG. 16 shows the sectional structure of vicinities of the differential pressure valve-storing chamber 103. A spring 120 and a membrane valve 122 are stored in the differential pressure valve-storing chamber 103. The membrane valve 122 is formed from an elastically deformable material such as elastomer or the like, and has a through-hole 121 in its center. The membrane valve 122 has an annular thick portion 122*a* provided in its circumference, and a frame portion 124 integral with the thick portion 122*a*. The membrane valve 122 is fixed to the container body 72 through the frame portion 124. The spring 120 has one end supported by a spring receiving portion 122*b* of the membrane valve 122, and the other end supported by a spring receiving portion 123*a* of a cover 123 for closing the chamber 103.

In FIG. 16, the reference numeral 125 designates a filter provided in the filter chamber 104; and 126 and 127, air-impermeable films stuck to the front surface of the container body 72 and the opening surface side thereof respectively. The film 126 is bonded to the frame 84 and the walls 80, 85, 92, 94, 96, 97, 100 and 112 as shown in FIG. 14, by welding or the like, so that the upper section ink chambers 86, 87 and 93 are formed.

In the aforementioned configuration, ink passing through the filter 125 passes through the ink flow ports 95*a* but is blocked by the membrane valve 122. When the pressure of the ink supply port 74 is reduced in this condition, the membrane valve 122 is separated from the valve seat portion 95*b* against the urging force of the spring 120. Hence, the ink passes through the through-hole 121 and flows into the ink supply port 74 via the flow passage formed by the recessed portion 105.

When the ink pressure of the ink supply port 74 is increased to a predetermined value, the membrane valve 122 is moved by the urging force of the spring 120. Hence, the membrane valve 122 is brought into elastic contact with the valve seat portion 95*b*, so that a flow of ink is blocked. When the aforementioned operation is repeated, ink can be supplied into the ink supply port 74 while the ink pressure is kept at a constant negative pressure value.

Figure 17:
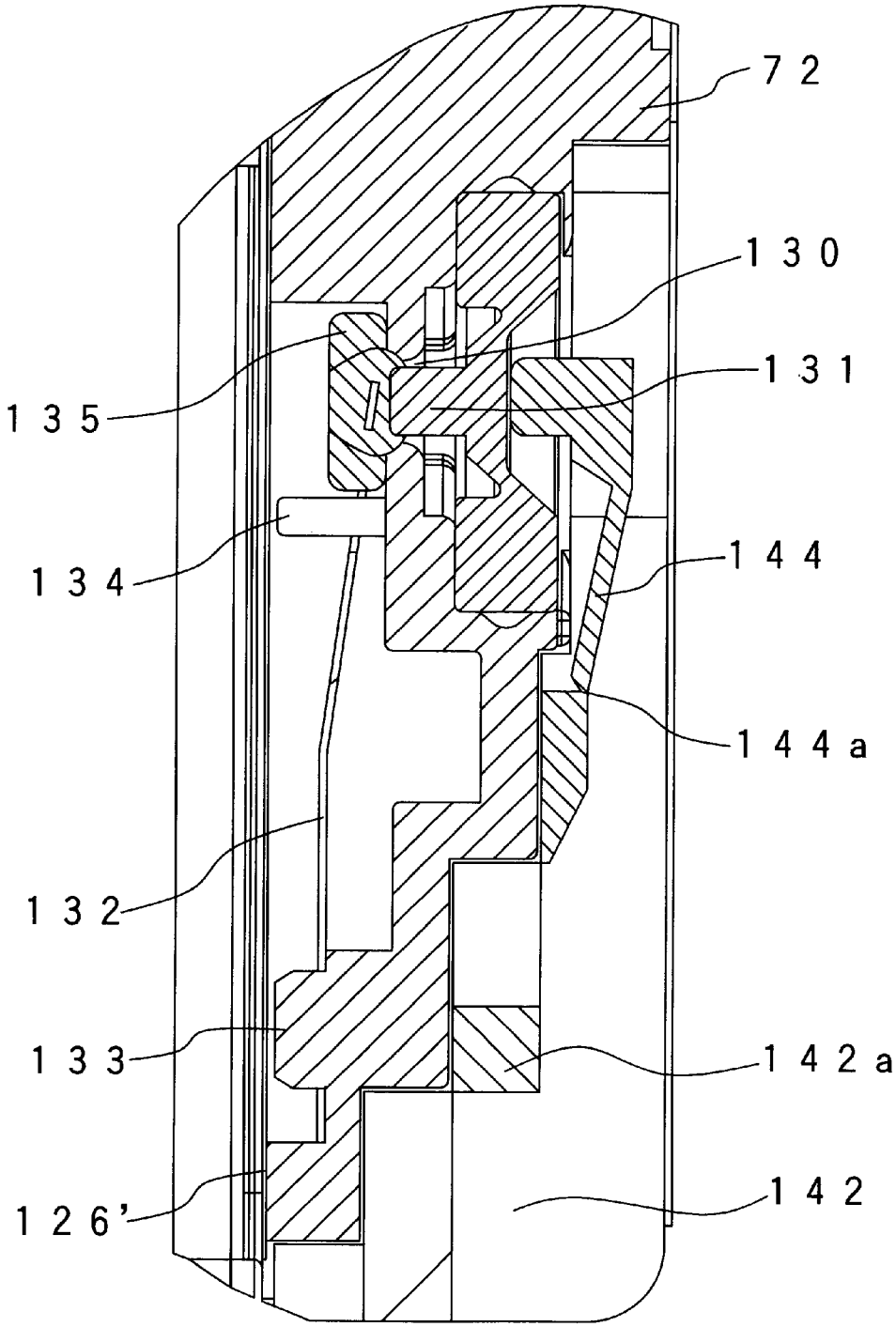
FIG. 17 is an enlarged view showing the sectional structure of the air communication valve-storing chamber.

FIG. 17 shows the sectional structure of the air communication valve-storing chamber 78. A through-hole 130 is formed in a wall partitioning the valve-storing chamber 78. A pressing member 131 formed from an elastic member such as rubber is movably inserted into the through-hole 130 while the periphery of the pressing member 131 is supported by the container body 72A valve body 135 is supported by an elastic member such a leaf spring 132 having a lower end fixed by a protrusion 133 and a center portion restricted by a protrusion 134, so that the valve body 135 is always urged toward the through-hole 130. The valve body 135 is disposed at the entering side front end of the pressing member 131.

Figure 18A:
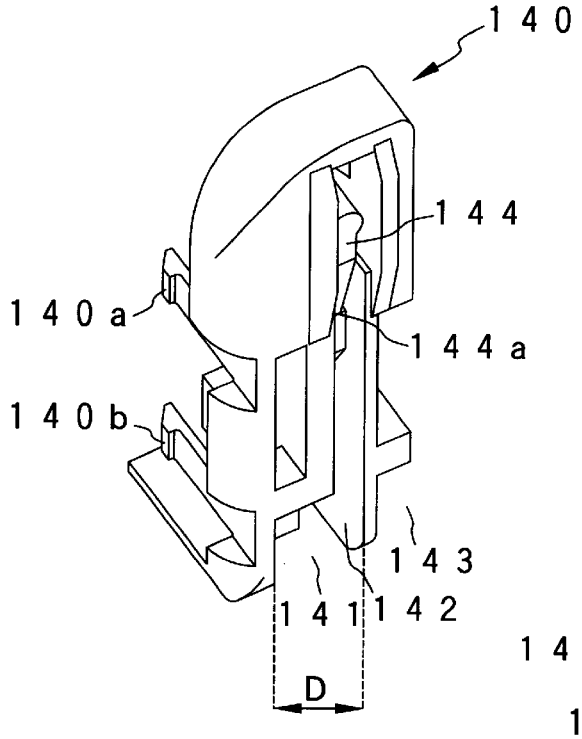
FIGS. 18A and 18B are a perspective view and a front view showing an embodiment of the identification block.
Figure 18B:
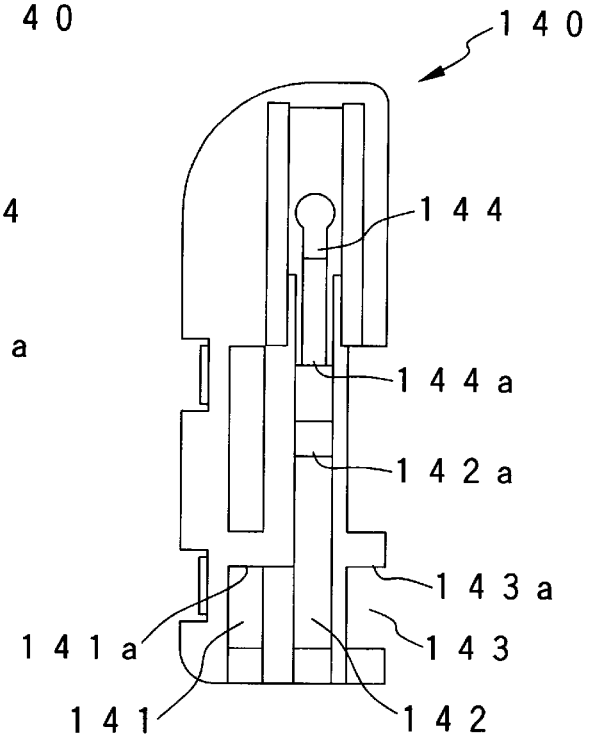
Figure 18C:
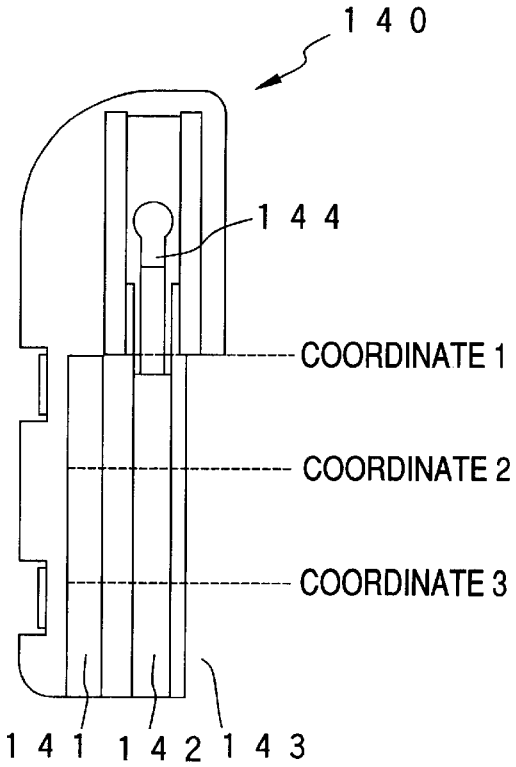
FIG. 18C is a view showing coordinate points set in the identification block.

The identification block 140 as shown in FIGS. 18A to 18C is attached to the container body 72 so that the identification block 140 is located adjacent to the air communication valve-storing chamber 78 and that the pressing member 131 of the valve member 135 can be displaced. The identification block 140 has a base body that is fixed to the recessed portion 150 (FIG. 15A) of the container body 72 by claws 140*a* and 140*b* The base body of the identification block 140 is formed with a plurality of grooves (for example, three grooves 141, 142 and 143 in this embodiment), each parallel with the insertion direction of the ink cartridge 71 and having a predetermined width in the width direction of ink cartridge 71. Further, an arm 144 for displacing the pressing member 131 is integrally formed in a predetermined position within a specific one of the grooves (within the groove 142 in this embodiment).

An opening portion is widened as indicated by D on the identification piece-entrance side (lower portion in FIGS. 18A to 18C) of the groove 142 in which the arm 144 is disposed, so that the opening portion of the groove 142 is integrated with one of adjacent grooves (for example, the groove 141 in this embodiment). Hence, even in the case where the position of the operating rod 213 (FIG. 21) changes slightly when the ink cartridge 71 is attached to the carriage 200, the operating rod 213 can be received and guided by the wide opening portion D so as to enter the groove 142.

Figure 21:
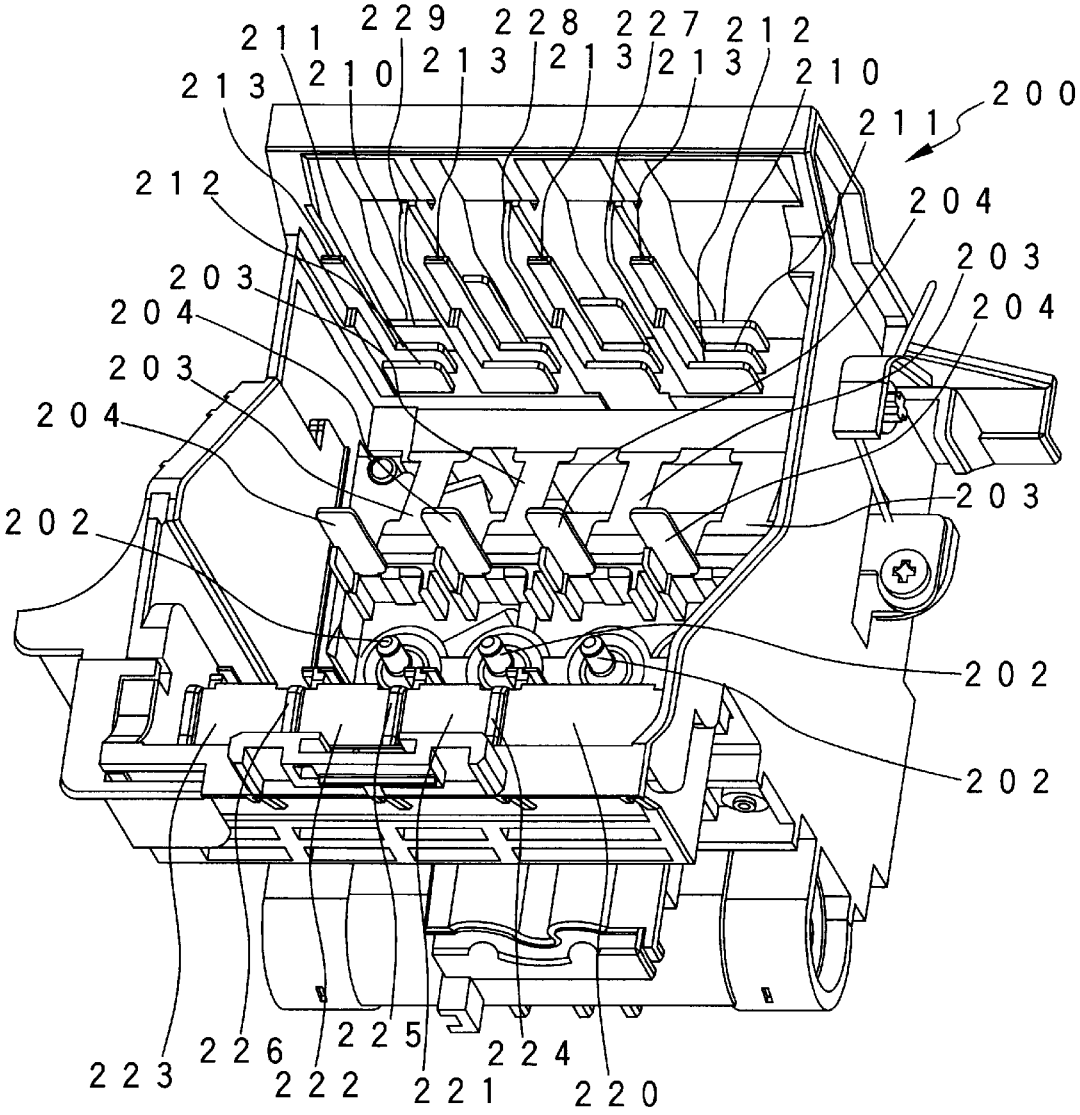
FIG. 21 is a perspective view showing a state in which the direction of the carriage is changed.

The arm 144 can be rotated about a rotational fulcrum 144*a* so as to be located slightly inward. The arm 144 is formed so that the pull-out side, i.e. the upper side in this embodiment, of the arm 144 is protruded obliquely into the entrance path of the operating rod 213 (FIG. 21). Further, identification protruded portions 141*a*, 142*a* and 143*a* are formed in the grooves 141 to 143 respectively so as to be opposite to leading ends of the identification pieces 210, 211 and 212 of the carriage. 200.

Figure 19A:
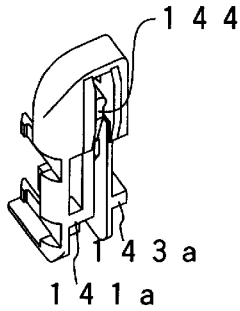
FIGS. 19A and 19A' to FIGS. 19F and 19F' are perspective views and front views showing the form of the identifiable protruded portions of the identification blocks.
Figure 19A:
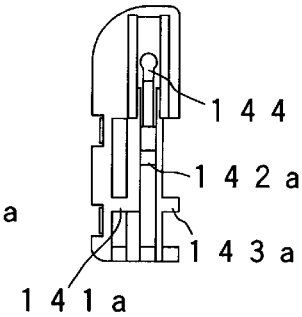
Figure 19B:
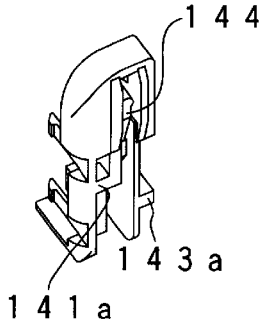
Figure 19B:
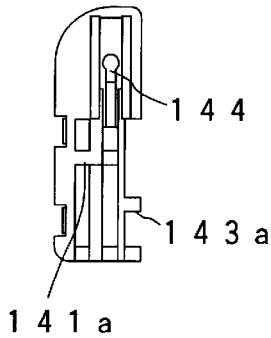
Figure 19C:
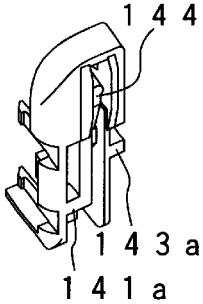
Figure 19C:
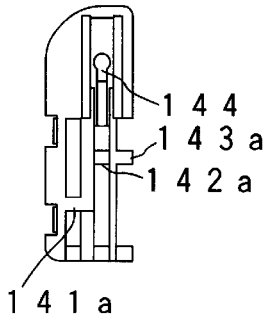
Figure 19D:
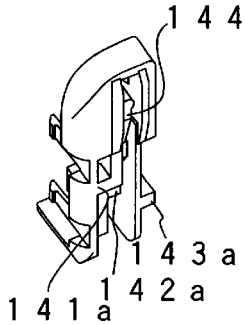
Figure 19D:
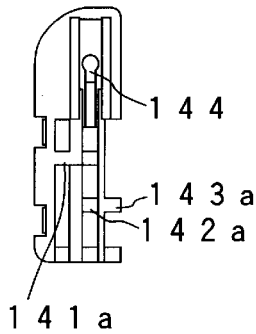
Figure 19E:
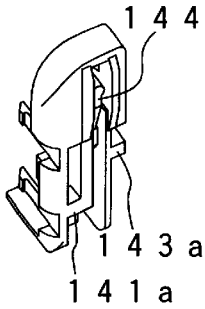
Figure 19E:
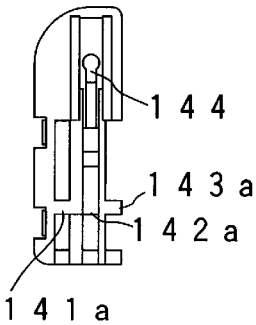
Figure 19F:
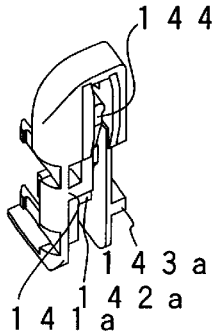
Figure 19F:
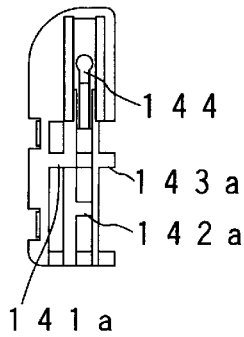

With the aforementioned configuration, the position of the arm 144 is kept constant, and the positions of the protruded portions 141*a*, 142*a*and 143*a* are changed within the grooves 141, 142 and 143 respectively as shown in FIGS. 19A and 19A' through FIGS. 19F and 19F'. Further, the positions of leading ends of the identification pieces 210, 211 and 212 are set correspondingly in accordance with the protruded portions 141*a*, 142*a* and 143*a* of the ink cartridge 71 allowed to be attached. As a result, the ink cartridge 71 storing incompatible ink therein can be prevented from being attached to the carriage 200.

Because the positions of the protruded portions 141*a*, 142*a* and 143*a* can be changed not only in the insertion/removal direction of the ink cartridge 71 but also in the thickness direction of the ink cartridge 71, the protruded portions 141*a*, 142*a* and 143*a* can be arranged three-dimensionally. Accordingly, a lot of kinds of ink can be identified without enlargement of the identification region-forming area. If the depth of each groove 141, 142 and 143 (a length in the thickness direction of the container body 2) is set to be such a size that a plurality of identification pieces 210, 211, 212 can be inserted into each groove, a larger number of kinds of ink can be identified.

Figure 20:
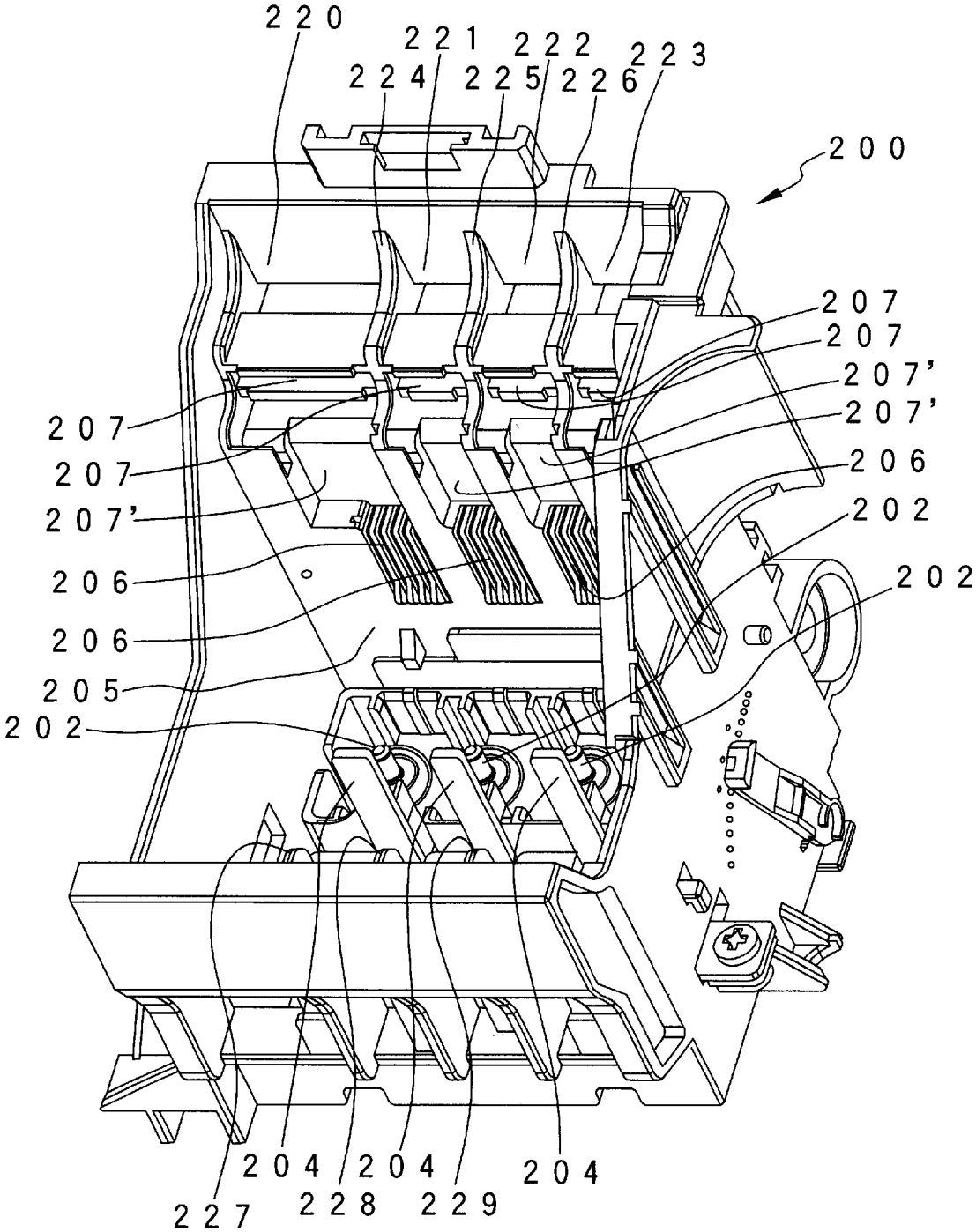
FIG. 20 is a perspective view showing an embodiment of the carriage configured so that a plurality of ink cartridges can be received.

FIGS. 20 and 21 show an embodiment of the carriage to which ink cartridges are attached. A plurality of ink cartridges can be attached. This embodiment is configured so that one black ink cartridge and three color ink cartridges can be attached. The color, as with all of the embodiments, may include dense and light inks (e.g., dense cyan and light cyan), and clear ink.

That is, a first attachment region 220 which is slightly wider is provided on one side. Second, third and fourth attachment regions 221 to 223 which have the same width are partitioned by ribs 224 to 226 and ribs 227 to 229 at opposite ends so as to, be adjacent to the first attachment region 220.

As described above with reference to FIG. 11, each of the ink cartridge attachment regions has an ink supply needle 202 communicated with a recording head 201, a pressing member, i.e. a leaf or plate spring 203 in this embodiment, provided in a region far from the region in which the ink supply needle 202 is provided, and a positioning protruded piece 204 formed between the leaf spring 203 and the ink supply needle 202 so as to extend in the insertion/removal direction of the ink cartridge.

Further, electrodes 206 are disposed on a side wall 205 on the ink supply needle 202 side. Recessed portions 207 fitted to the protrusions 75*a* of the retaining members 75 are formed above the electrodes 206.

Figure 9A:
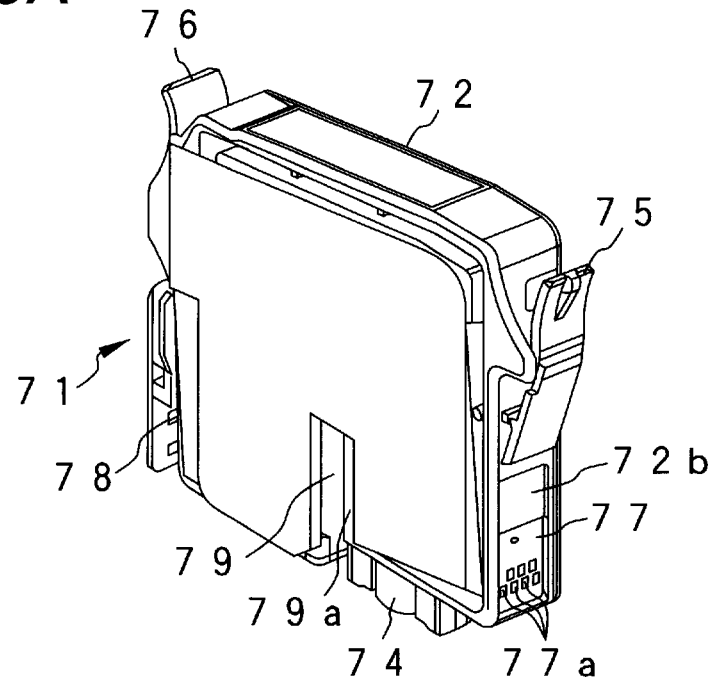
FIGS. 9A and 9B are views showing the external appearance of the front and rear of the ink cartridge according to a further embodiment of the present invention.
Figure 9B:
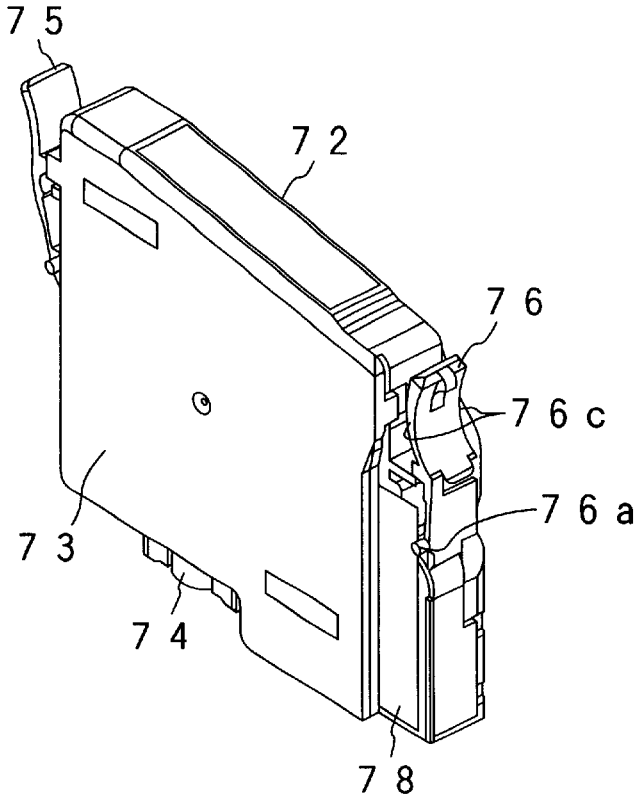
Figure 10A:
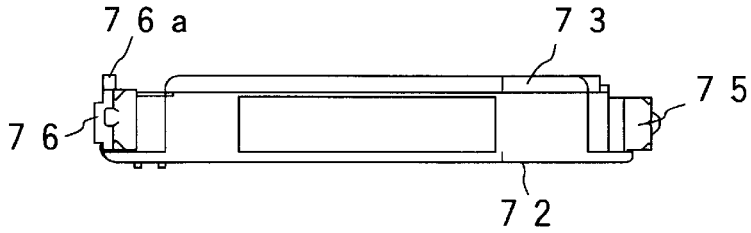
FIGS. 10A to 10D are a top view, a front view, a bottom view and a side view of the ink cartridge of FIG. 9.
Figure 10B:
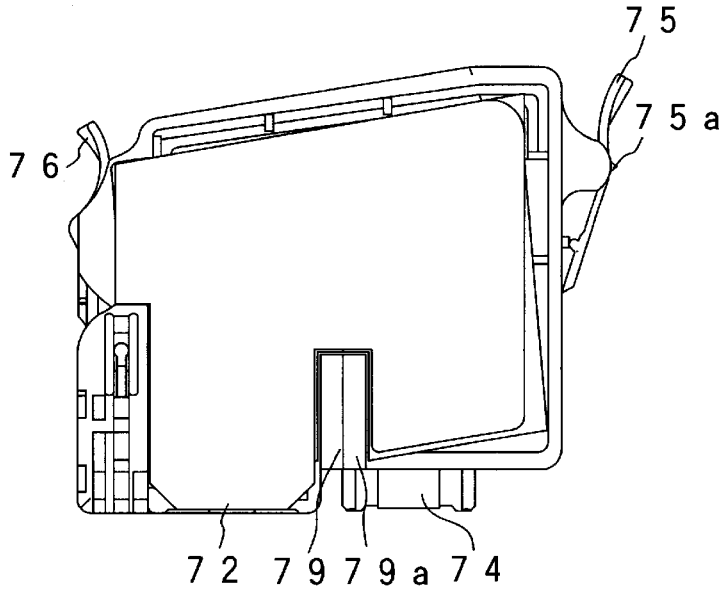
Figure 10D:
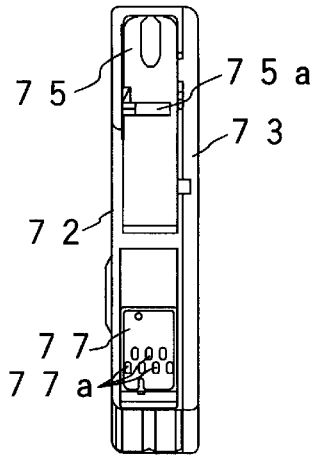
Figure 10C:
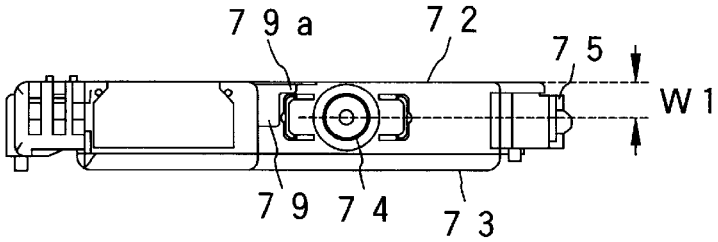
Figure 22A:
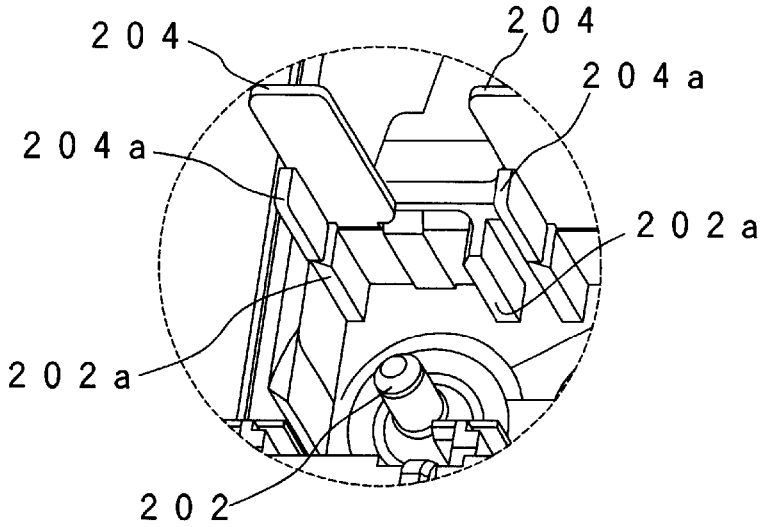
FIGS. 22A and 22B are enlarged views showing a neighborhood of the ink supply needle in the carriage and a neighborhood of the ink supply port in the ink cartridge.
Figure 22B:
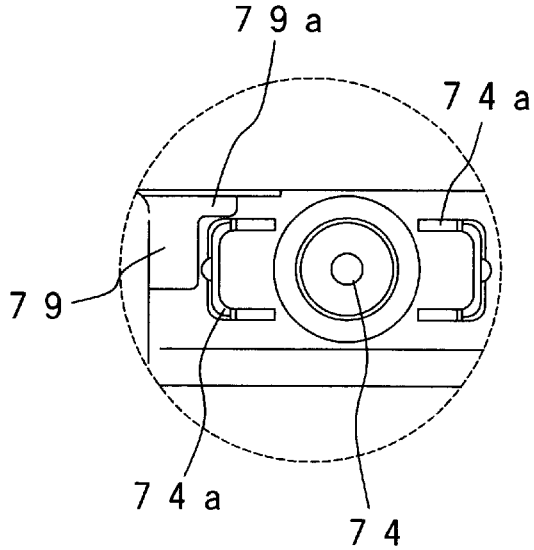

In this embodiment, the positioning protruded piece 204 is formed with a side portion 204*a* extending in parallel with the front surface of the ink cartridge 71 as shown in FIG. 22A to ensure the reliable positioning of the ink cartridge and reinforce the strength of the thin and long protruded piece 204. In order to cope with this structure, the leading end of the slit portion 79 of the ink cartridge 71 in the insertion direction of the ink cartridge 71 is extended to the front surface side while a recessed portion 79*a* is formed at least in a region opposite to the side portion 204*a* as shown in FIGS. 9A, 10B and 22B. That is, at least the cartridge insertion leading end of the slit portion 79 is formed with the recessed portion 79*a* to present a substantially L-shape in section to match with the protruded piece 204 and the side portion 204*a*.

A pair of ribs 74*a*, 74*a*, each U-shaped in section are formed in the ink cartridge 71 to interpose the ink supply port 74 therebetween as shown in FIG. 22B, whereas mating ribs 202*a* for engagement with the ribs 74*a*, 74*a* are formed around the ink supply needle 202 (FIG. 22A). These ribs can keep the ink supply needle 202 in a state in which the ink supply needle 202 is inserted into the ink supply port 74.

When the ink cartridge 71 is attached to the carriage 200 configured as described above, the identification pieces 210, 211 and 212 of the carriage 200 enter the grooves 141, 142 and 143 respectively in the identification block 140. Further, the operating rod 213 enters the groove 142. When the ink cartridge 71 is suitable to the attachment region, the ink supply port 74 of the ink cartridge 71 is moved to a position where the ink supply port 74 can be fitted to the ink supply needle 202. In this process, the operating rod 213 presses the arm 144 of the identification block 140 to thereby open the valve member 135 of the air communication valve-storing chamber 78. Hence, the first ink chamber 81 of the ink cartridge 71 is communicated with the air so that ink can be supplied to the recording head as described above.

On the other hand, when an ink cartridge not suitable for the attachment region is attached, any one of the identification protruded portions 141*a*, 142*a* and 143*a* in the grooves 141, 142 and 143 of the identification block 140 collides with any one of the identification pieces 210, 211 and 212 of the carriage 200, to thereby inhibit the movement of the ink cartridge 71 before the ink supply port 74 is fitted to the ink supply needle 202. Hence, the mistaken attachment can be found before the ink supply port 74 is fitted to the ink supply needle 202 and before the operating rod 213 presses the arm 144 of the identification block 140.

The function of the identification block will be described in detail.

Assuming, for example, that three identification piece insertable regions, i.e. three grooves 141, 142 and 143 are prepared as in the case of the identification block 140 shown in FIGS. 19A and 19A' through FIGS. 19F and 19F', and that the number of identifiable regions, i.e. the number of coordinate points, in each of the insertable regions, is three as shown in FIG. 18C, 27 different patterns can be set for identification as shown in Table 1.

TABLE 1

| pattern | a | b | C |
|---|---|---|---|
| 1 | 1 | 1 | 1 |
| 2 | 1 | 1 | 2 |
| 3 | 1 | 1 | 3 |
| 4 | 1 | 2 | 1 |
| 5 | 1 | 2 | 2 |
| 6 | 1 | 2 | 3 |
| 7 | 1 | 3 | 1 |
| 8 | 1 | 3 | 2 |
| 9 | 1 | 3 | 3 |
| 10 | 2 | 1 | 1 |
| 11 | 2 | 1 | 2 |
| 12 | 2 | 1 | 3 |
| 13 | 2 | 2 | 1 |
| 14 | 2 | 2 | 2 |
| 15 | 2 | 2 | 3 |
| 16 | 2 | 3 | 1 |
| 17 | 2 | 3 | 2 |
| 18 | 2 | 3 | 3 |
| 19 | 3 | 1 | 1 |
| 20 | 3 | 1 | 2 |
| 21 | 3 | 1 | 3 |
| 22 | 3 | 2 | 1 |
| 23 | 3 | 2 | 2 |
| 24 | 3 | 2 | 3 |
| 25 | 3 | 3 | 1 |
| 26 | 3 | 3 | 2 |
| 27 | 3 | 3 | 3 |

Incidentally, in Table 1, the reference characters a, b and c designate three identification piece insertable regions (i.e., the grooves 141, 142 and 143 in this embodiment), and the numerical values 1, 2 and 3 designate the relative positions of the identification pieces in the insertion/removal direction of the cartridge (i.e., the coordinate points 1 to 3 in FIG. 18C)

In the aforementioned embodiment, the arm 144 for displacing the pressing member 131 of the air opening valve is disposed on the frontmost end side in one of the identification piece insertable regions, that is, in the groove 142. Therefore, the coordinate points which can be set in the groove 142 are two. Hence, in this case, 18 patterns can be set for identification as shown in Table 2. That is, in this case, as shown in Table 2, the coordinate point 3 can not be set in the insertable region b.

TABLE 2

| pattern | a | b | C |
|---|---|---|---|
| 1 | 1 | 1 | 1 |
| 2 | 1 | 1 | 2 |
| 3 | 1 | 1 | 3 |
| 4 | 1 | 2 | 1 |
| 5 | 1 | 2 | 2 |
| 6 | 1 | 2 | 3 |
| 7 | 1 | X | 1 |
| 8 | 1 | X | 2 |
| 9 | 1 | X | 3 |
| 10 | 2 | 1 | 1 |
| 11 | 2 | 1 | 2 |
| 12 | 2 | 1 | 3 |
| 13 | 2 | 2 | 1 |
| 14 | 2 | 2 | 2 |
| 15 | 2 | 2 | 3 |
| 16 | 2 | X | 1 |
| 17 | 2 | X | 2 |

TABLE 2-continued

| pattern | a | b | C |
|---|---|---|---|
| 18 | 2 | X | 3 |
| 19 | 3 | 1 | 1 |
| 20 | 3 | 1 | 2 |
| 21 | 3 | 1 | 3 |
| 22 | 3 | 2 | 1 |
| 23 | 3 | 2 | 2 |
| 24 | 3 | 2 | 3 |
| 25 | 3 | X | 1 |
| 26 | 3 | X | 2 |
| 27 | 3 | X | 3 |

Figure 23A:
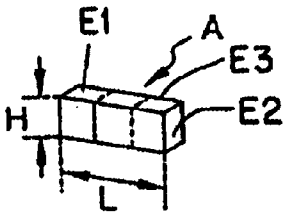
FIGS. 23A to 23C are views showing shapes suitable for identification pieces.
Figure 23B:
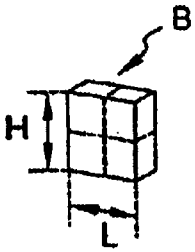
Figure 23B:
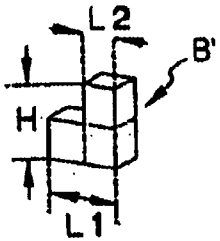
Figure 23C:
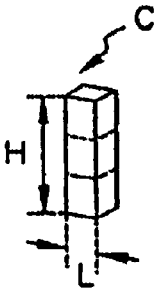

As to the configuration of each of the identification pieces 210, 211 and 213 for the aforementioned identification block 140, the following three patterns are conceivable as shown in FIGS. 23A to 23C:

pattern A in which the relative height H is 1 and the relative length L of the deep side of the groove is 3;

pattern B in which the relative height H is 2 and the relative length L of the deep side of the groove is 2 or pattern B' in which the relative height H is 2, the relative length L1 of the lower deep side of the groove is 2 and the relative length L2 of the upper deep side of the groove is 1; and pattern C in which the relative height H is 3 and the relative length L of the deep side of the groove is 1.

Selected one of these patterns A to C is used as each of the identification pieces 210, 211 and 213 to correspond to a respective one of the grooves 141, 142 and 143. This makes it possible to identify 18 different types of cartridges one from the others. With specific reference to FIG. 23A, there is shown an exemplary illustration of an end portion E1 of an identification piece in a first direction, an end portion E2 of the identification piece in a second direction, and a location where the identification piece is formed E3 in a third direction.

Figure 23D:
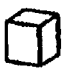
FIGS. 23D to 23F are views showing shapes unsuitable for identification pieces.
Figure 23E:
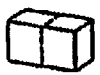
Figure 23F:
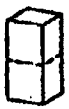

In addition, in case of identification piece patterns as shown in FIGS. 23D to 23F, since these patterns are smaller than the patterns A to C and thus can enter the grooves designed for identifying the patterns A to C, an unsuitable ink cartridge cannot be excluded surely. However, these patterns may be used if an appropriate pattern combination is applied.

Figure 24A:
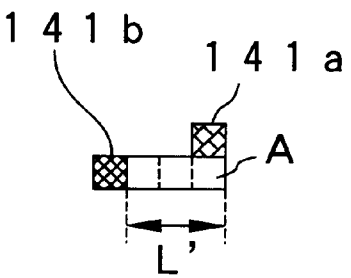
FIGS. 24A to 24C are views showing the limiting portion which is to be formed in the identification block so that the identification pieces are identified by the identification block.
Figure 24B:
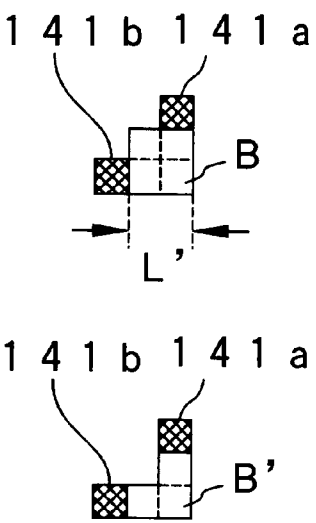
Figure 24C:
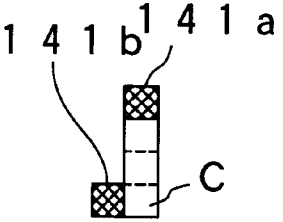
Figure 25D:
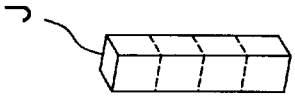
FIGS. 25A to 25D are views showing another embodiment of the identification pieces.
Figure 25C:
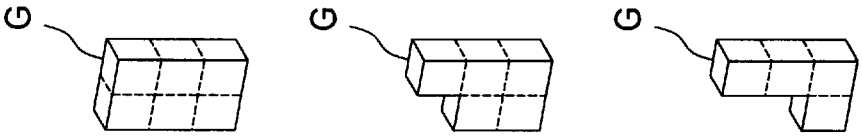
Figure 25B:
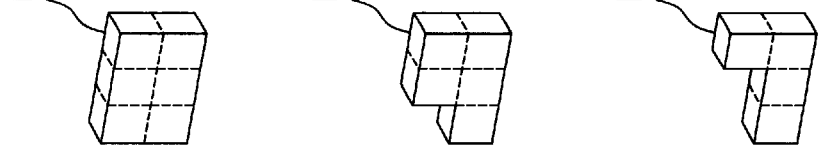
Figure 25A:
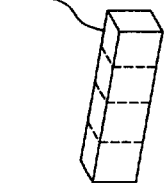
Figure 26A:
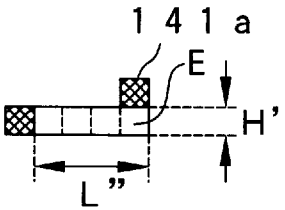
FIGS. 26A to 26D are views showing the limiting portion which is to be formed in the identification block so that the identification pieces are identified by the identification block.
Figure 26B:
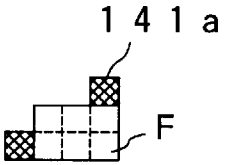
Figure 26C:
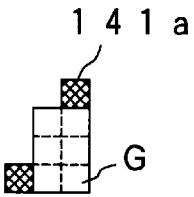
Figure 26D:
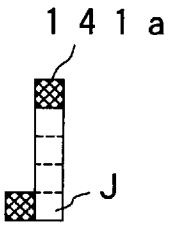

Further, in each of the identification block grooves 141, 142 and 143, not only the protruded portion (141*a* in FIGS. 24A to 24C) for restricting the relative height of the identification piece pattern but also a portion (141*b* in FIGS. 24A to 24C) for restricting the relative length of the identification piece pattern are provided to correspond to the selected one of the identification piece patterns A to C. That is, the coordinate points (141*b* in FIGS. 24A to 24C) represented by cross hatching are also restricted so that the depth of the identification block groove 141, 142, 143 is set to have a relative length L' of 3 for the pattern A, a relative length L' of 2 for the patterns B and B' and a relative length L' of 1 for the pattern C. This makes it possible to surely identify the three kinds of patterns A to C one from the other with the groove 141, 142, 143. Accordingly, the ink cartridge 71 can be prevented from being inserted by mistake. (In addition, in this case, since the identification piece pattern B and the identification piece pattern B' are different in shape from each other, but can be properly inserted into the same identification block groove, either one of the patterns B and B' can be used in combination with the other patterns A and C. That is, in this case, the pattern B can not be distinguished from the pattern B'.)

Similarly, in case where four grooves are provided to the identification block 140, each of the grooves 141, 142 and 143 is set to have a relative length of 4 in the depth direction and a relative height of 4 in the cartridge insertion/removal direction. As to the corresponding identification pieces, as shown in FIGS. 25A to 25D, there are prepared:

pattern E in which the relative height H is 1 and the relative a length L is 4;

patterns F to F" in which the relative height H is 2 and the relative length L is 3;

patterns G to G" in which the relative height H is 3 and the relative length L is 2; and pattern J in which the relative height H is 4 and the relative length L is 1.

Hence, as described above, by restricting at least the relative height H' and the relative length (depth) L' of the groove as shown by cross hatching in FIGS. 26A to 26D, the identification pieces can be identified one from the other.

That is, if a number N (N is an integer not smaller than 3) of coordinate points are provided in each of the directions parallel to the insertion direction of the ink cartridge and the depth direction of the ink cartridge, the identification pieces may be preferably formed so that:

the first pattern identification piece has an end portion that reaches the first coordinate point in a coordinate axis direction parallel with the insertion direction of the ink cartridge, and an end portion that reaches the n-th coordinate point in a coordinate axial direction parallel to the depth of the ink cartridge;

the i-th (i is an integer satisfying the relation $2 \leqq i \leqq (n-1)$) pattern identification piece has an end portion that reaches the i-th coordinate point in the coordinate axis direction parallel with the insertion direction of the ink cartridge, and an end portion that reaches the (n−i+1)-th coordinate point in the coordinate axis direction parallel to the depth of the ink cartridge; and the n-th pattern identification piece has an end portion that reaches the n-th coordinate point in the coordinate axis direction parallel with the direction of insertion of the ink cartridge, and an end portion that reaches the first coordinate point in the coordinate axis direction parallel to the depth of the ink cartridge.

Figure 27A:
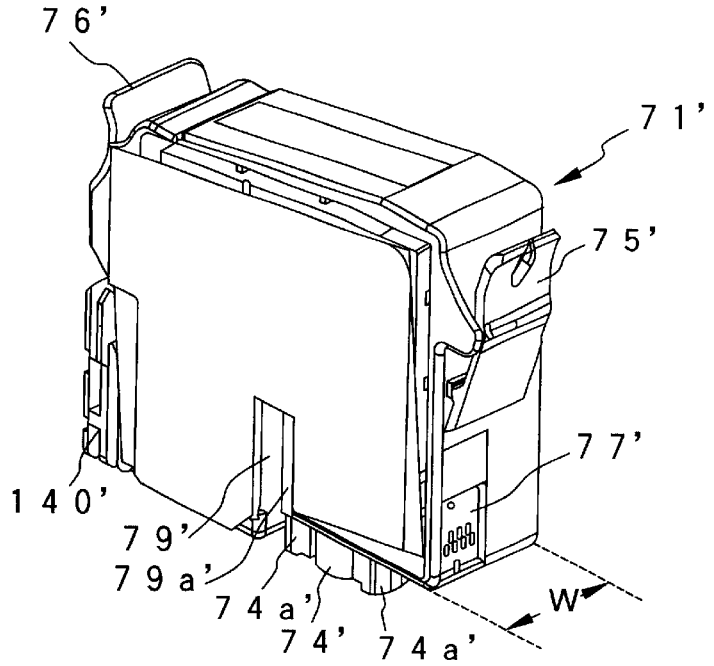
FIGS. 27A to 27C are perspective views and a bottom view showing an even further exemplary embodiment of the ink cartridge according to the present invention.
Figure 27B:
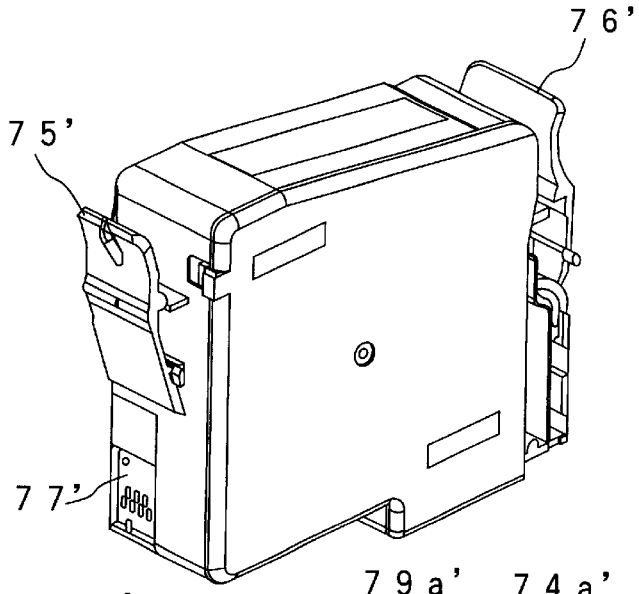
Figure 27C:
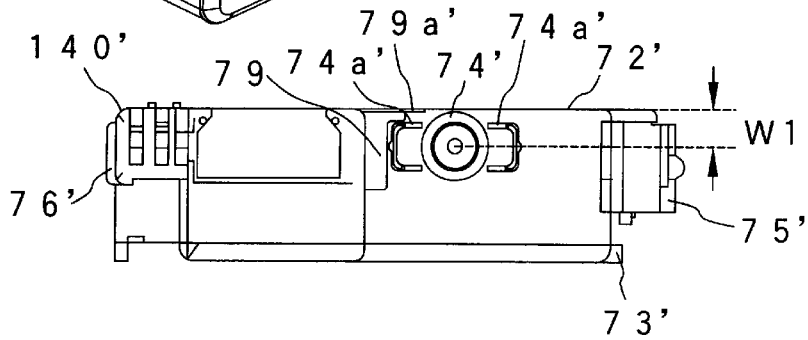

Incidentally, the ink cartridge 71' (FIGS. 27A to C) attached to the wide attachment region 220 is basically the same in structure as the ink cartridges 71 attached to the second to fourth attachment regions 221, 222, 223 and shown in FIGS. 10 through 17. As shown in FIG. 27, the container body 72' of the ink cartridge 71' is however formed so that the shape of the opening surface is not changed but only the depth W is increased. Hence, the quantity of ink allowed to be stored in the ink cartridge 71' can be increased by simply changing the depth W of the container body 72'.

The arrangement center of the ink supply port 74' and the memory device 77' is set to be located at a constant position W1 from the front surface, i.e. the closed side, of the container body 72' in the same manner as in other exemplary ink cartridges 71. Because the identification block 140'. (FIGS. 28A and B) is attached to the front surface side of the container body 72', it is a matter of course that the distance of the identification block 140' from the front surface of the container body 72' is the same as those in the other ink cartridges 71.

The retaining member 75' is located offset to the side of the container body 72' in the same manner as the offset location of the ink supply port 74' as shown in FIG. 27C so that pressing force surely acts on the ink supply port 74" at the time of attachment of the ink cartridge 71'.

Figure 28A:
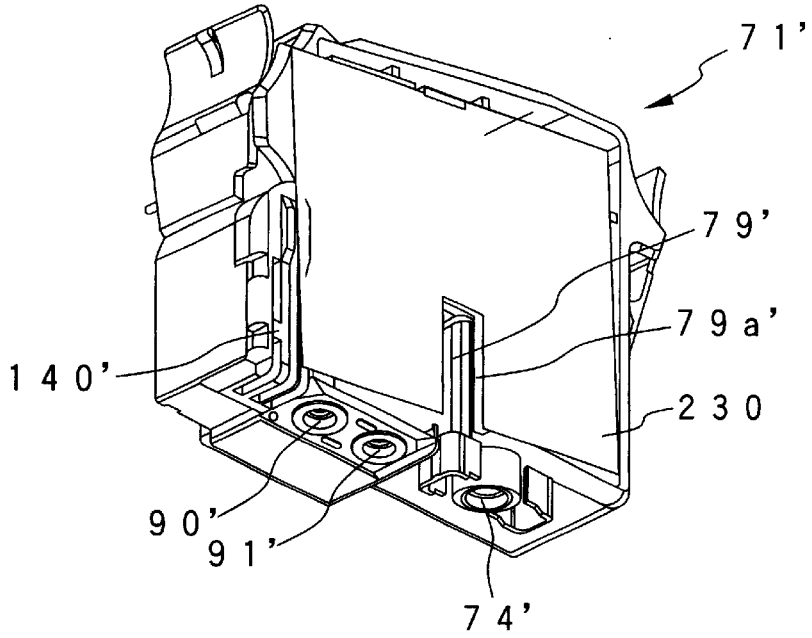
FIGS. 28A and 28B are views showing the sealing structure of the ink injection port in the ink cartridge of FIG. 27.
Figure 28B:
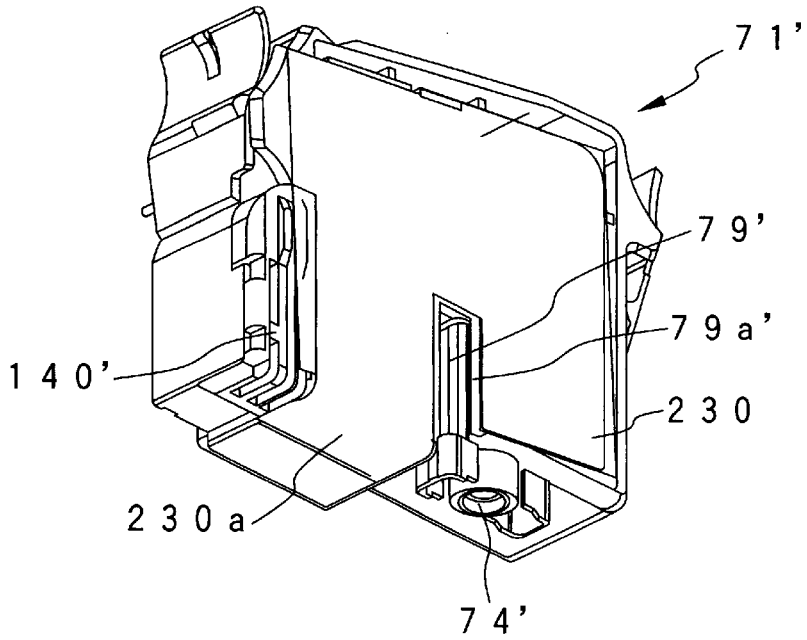

A decorative film 230 may be further bonded to the container body 72, 721 as shown in FIGS. 28A. The decorative film 230 may be formed with a tongue portion 230*a* in a region corresponding to ink injection ports 90, 90', 91, 91' so that the ink injection ports 90, 90', 91, 91' are sealed with the tongue portion 230*a* as shown in FIG. 28B.

Although in the aforementioned embodiment the identification protruded portions are integrally formed in the identification block, the present invention may be applied also to the case where holes are formed in the identification block and pins are inserted into the holes. For example, holes are arrayed in the height direction in each identification piece insertable groove, and a pin is inserted into a selected one of the holes to extend at least partially across the groove, to thereby constitute the height restricting portion. Of course, holes may be arrayed in the depth direction. Further, a protruded length of each pin may be selected appropriately.

Figure 29:
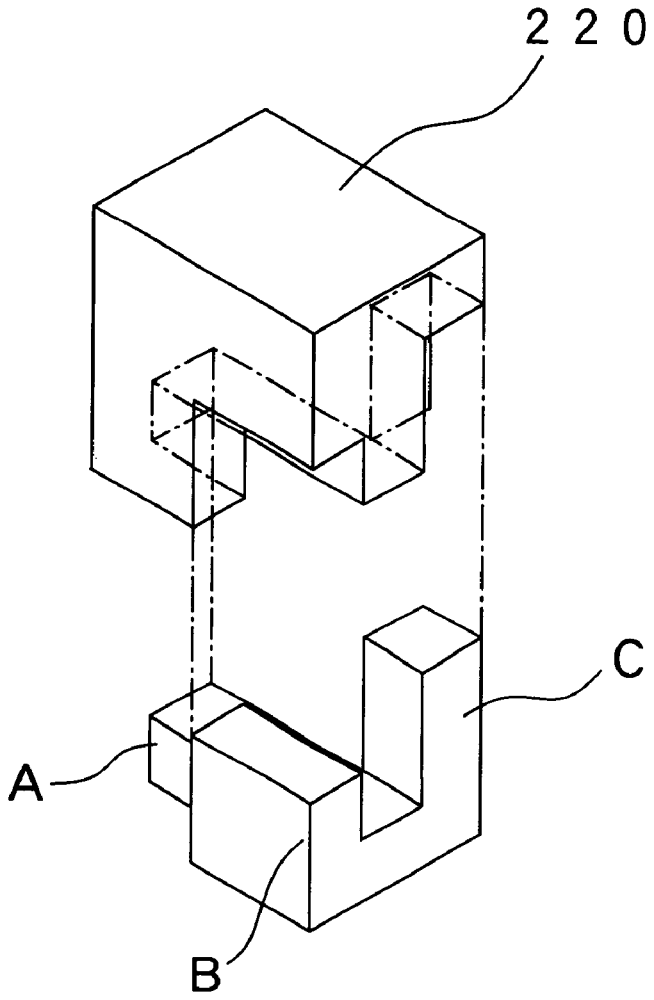
FIG. 29 is a perspective view showing another embodiment of the identification block.

Although in the aforementioned embodiment a plurality of grooves are formed in the identification block so that the identification protruded portions are formed in the grooves, the same effect as described above can be obtained even in the case where the identification block is formed as a block 220 having recessed portions coincident with the external shapes of the identification pieces A, B and C as shown in FIG. 29. In this case, if a gap, through which the operating rod 213 can enter for opening the valve member 135, is formed between the block 220 and the ink cartridge 71, or if a recessed portion or a through-hole may be formed in the block per se, the block can be disposed near the valve member.

If the identification block need not be disposed near the opening/closing valve member, identification pieces constituted by protruded pieces may be provided to the container constituting the ink cartridge, and the identification block may be attached and fixed to a corresponding place of the carriage.

Further, the identification pieces/the identification block and the memory device of the ink cartridge may be used in combination for identification of the ink cartridge. Between ink cartridges that do not cause attachment error, the ink cartridge may be judged, based on the formation stored in the memory device, as to whether the ink cartridge is adaptable or not.

Further, the identification fitting portions (the, identification protruded portions) need not abut against the identification pieces That is, a clearance may be set between the fitting portion and the identification piece to such a degree that one identification piece can be discriminated from another identification piece.

Although the aforementioned embodiment uses the differential pressure valve as a negative pressure generating mechanism, the same effect as described above can be obtained even in the case where a porous member such as sponge is impregnated with ink so that negative pressure is kept by the capillary force of the fine pores of the porous member.

The kind of ink or item(s) to be identified includes at least one of an ink color, a type of colorant and a type of solvent.

As described above, in accordance with the present invention, a space is used such that identification limiting portions are disposed three-dimensionally. Hence, the number of combinations for identification purpose is increased, and therefore various kinds of ink cartridges adapted to the recording device can be attached without mistake.

What is claimed is:

1. An ink-jet recording device for supplying ink to a recording head from at least one ink cartridge having an ink supply port, the recording device comprising:

first and second identification members for identification of an appropriate ink cartridge, which are protruded in a first direction parallel to an insertion direction of the ink cartridge into the recording device, wherein:

each of the first and second identification members has a shape corresponding to the ink cartridge, each of the first and second identification members reaching a corresponding one of a plurality of three-dimensionally arranged coordinate points, which is selected in accordance with the ink cartridge; and the coordinate points are defined by dividing each of the three-dimensional space axes into a plurality of sections;

wherein a height of the first identification member in the first direction is larger than a height of the second identification member in the first direction; and wherein a depth of the first identification member in a second direction perpendicular to the first direction is smaller than a depth of the second identification member in the second direction.

2. The recording device according to claim 1, further comprising:

a third identification member, each of the first, second and third identification members having a respective different shape.

3. The recording device according to claim 2, wherein positions where the first, second and third identification members are disposed in a third direction perpendicular to the first and second directions are determined in accordance with the identification items.

4. The recording device according to claim 1, wherein each of the first and second identification members has a volume not smaller than a predetermined value.

5. An ink cartridge comprising:

a container for storing ink;

an ink supply port disposed on one surface of the container;

a plurality of identification fitting portions shaped to identify a property of the ink cartridge, wherein:

each of the identification fitting portions is located proximate a corresponding one of a plurality of dimensionally arranged coordinate points, which is selected in accordance with an identification item to thereby define at least first and second identification member insertion portions;

the coordinate points are defined by dividing each of the three-dimensional space axes containing the surface into a plurality of sections;

wherein a length of the first insertion portion in a height direction is larger than a length of the second insertion portion in the height direction; and wherein a length of the first insertion portion in a depth direction is smaller than a length of the second insertion portion in the depth direction.

6. The ink cartridge according to claim 5, wherein the identification fitting portions are integral with the container.

7. The ink cartridge according to claim 5, further comprising:

a recessed portion formed in the container; and a block that has the identification fitting portion and that is adapted to be inserted and fixed to the recessed portion.

8. The ink cartridge according to claim 7, wherein:

the container has an ink chamber, a valve chamber, and a normally closed valve member the ink chamber being in fluid communication with the ambient atmosphere via the valve member when the normally closed valve member is in an open position; and the block is attached to the container at a position adjacent to the valve-storing chamber.

9. The ink cartridge according to claim 7, wherein:

the container has an ink chamber, and a normally closed valve member; the ink chamber being in fluid communication with the ambient atmosphere when the normally closed valve member is in an open position; and a space, through which an operating rod disposed on a recording device for opening the valve member is adapted to be inserted, is defined in a plane parallel to the direction of projection of the block.

10. The ink cartridge according to claim 7, wherein:

the block is formed with the first and second insertion portions, each in the form of a groove that extends parallel to an insertion direction of the ink cartridge and that has an identification fitting portion located at a specified position in the insertion direction corresponding to a kind of ink.

11. The ink cartridge according to claim 9, wherein:

a space, through which an operating rod disposed on the recording device for opening the valve member is insertable, is disposed in a groove adjacent to the first and second insertion portions.

12. The ink cartridge according to claim 11, wherein a leading end opening of the block in an entrance direction of the operating rod is wider than a width of the groove.

13. The ink cartridge according to claim 10, wherein:

an arm is formed in a groove adjacent to the first and second insertion portions; and the arm is displaced by entrance of an operating rod disposed on the recording device, to thereby open a normally closed valve member disposed in the container.

14. The ink cartridge according to claim 10, wherein: each of the grooves has a constant width and a depth adapted to permit a plurality of the identification fitting portions to be disposed therein in a depth direction; and the identification fitting portions are disposed on each of the grooves, the configuration of the fitting portions corresponding to a kind of ink so that the identification fitting portions limit positions of the ink cartridge in the depth direction and height direction.

15. The ink cartridge according to claim 5, wherein the property of the ink cartridge is at least one of an ink color, a type of colorant and a type of solvent.

16. The ink cartridge according to claim 5, further comprising: a block that has the identification fitting portion and that is removably attached to the container.

17. The ink cartridge according to claim 5, further comprising: a block that has the identification fitting portion and that is permanently attached to the container.

18. An ink-jet recording device, adapted for mounting of an ink cartridge in an ink cartridge mounting region, for supplying ink to a recording head from the ink cartridge having an ink supply port, the recording device comprising:

first and second identification members disposed on the ink cartridge mounting region, and protruded in a first direction parallel to a cartridge insertion direction and in a second direction parallel to a cartridge depth direction, wherein a position of an end portion of each identification member in the first direction, a position of an end portion of each identification member in the second direction and a location where each identification member is formed in a third direction perpendicular to the cartridge insertion direction are defined in accordance with identification items; and the end portion of the first identification member in the first direction is positioned higher than the end portion of the second identification member in the first direction, and the end portion of the second identification member in the second direction is positioned deeper than the end portion of the first identification member in the second direction.

19. The recording device according to claim 18, wherein:

each of coordinate axes in the first and second directions is divided into a plurality of sections to obtain coordinate points that are equal in number for the coordinate axes; and the end portion of each of the identification members is shaped to correspond to selected coordinate points in the respective first and second directions, which are selected in accordance with identification items.

20. The recording device according to claim 19, wherein:

patterns that can be used as the identification members are predetermined; and the number of the patterns is equal to the number of the divided coordinate points in the coordinate axis.

21. The recording device according to claim 19, wherein:

three coordinate points are provided for each of the first and second directions;

three patterns are predetermined for the identification member;

a first one of the patterns for the identification member has an end portion that reaches a third coordinate point in the first direction, and an end portion that reaches a first coordinate point in the second direction;

a second one of the patterns for the identification member has an end portion that reaches a second coordinate point in the first direction, and an end portion that reaches a second coordinate point in the second direction; and a third one of the patterns for the identification member has an end portion that reaches a first coordinate point in the first direction, and an end portion that reaches a third coordinate point in the second direction.

22. The recording device according to claim 21, wherein:

each of the first and second identification members are determined by selecting one from the first, second and third patterns.

23. The recording device according to claim 18, wherein:

a number n (in which n is an integer not smaller than 3) of coordinate points are provided for each of the first and second directions;

first to n-th patterns are predetermined for the identification member;

the first pattern for the identification member has an end portion that reaches a first coordinate point in the first direction, and an end portion that reaches an n-th coordinate point in the second direction;

the i-th pattern (in which i is an integer satisfying the relation $2 \leqq i \leqq (n-1)$ for the identification member has an end portion that reaches an i-th coordinate point in the first direction, and an end portion that reaches a $(n-i+1)$-th coordinate point in the second direction; and the n-th pattern for the identification member has an end portion that reaches an n-th coordinate point in first direction, and an end portion that reaches a first coordinate point in the second direction.

24. The recording device according to claim 18, wherein identification members including the first and second identification members are arranged side by side in the third direction.

25. The recording device according to claim 18, wherein the position of the end portion of the identification member in the second direction is defined in relation to the position of the end portion of the identification member in the first direction.

26. An ink cartridge comprising:

an ink container;

an ink supply port disposed on the container; and a plurality of identification fitting portions, wherein:

a location of each identification fitting portion is determined with respect to a first direction parallel to a cartridge insertion direction, a second direction perpendicular to the first direction and a third direction perpendicular to both of the first and second directions, in accordance with identification items;

a first and a second of the identification fitting portions define a first insertion portion having a first length in the first direction and a second length in the second direction;

a third and a fourth of the identification fitting portions define a second insertion portion having a third length in the first direction and a fourth length in the second direction; and the first length is larger than the third length, and the second length is smaller than the fourth length.

27. The ink cartridge according to claim 24, wherein:

a coordinate axis in the first direction and a coordinate axis in the second direction are divided into the same number of sections to provide coordinate points; and the first and second identification fitting portions are respectively formed at coordinate points in the first and second directions in accordance with identification items.

28. The ink cartridge according to claim 26, wherein:

the first and second identification fitting portions are located in a first plane defined by the first and second directions the third and fourth identification portions are located in a second plane defined by the first and second directions; and the first and second planes are parallel to each other, and offset in the third direction.

29. The ink cartridge according to claim 26, wherein:

the location of the first identification fitting portion in the first direction is predetermined as a first position; and the location of the second identification fitting portion in the second direction is determined in relation to the first position.

30. The ink cartridge according to claim 26, wherein the first and second insertion portions axe arranged side by side in the third direction.

31. An ink cartridge comprising:

a container for storing ink;

an ink supply port having an axis extending in a first direction;

first and second grooves extending parallel to the first direction;

wherein a length of the first groove in the first direction is smaller than a length of the second groove in the first direction; and a length of the first groove in a second direction perpendicular to the first direction is larger than a length of the second groove in the second direction.

32. The ink cartridge according to claim 31, farther comprising:

a block attached to the container, wherein the first and second grooves are at least partly defined by the block.

33. The ink cartridge of claim 31, further comprising:

a slit that is fanned in the container and that extends parallel to the first direction, wherein the slit is closer to the ink supply port than to the first and second grooves.

34. The ink cartridge according to claim 31, wherein the first and second grooves are arranged in a third direction perpendicular to the first and second directions.

35. The ink cartridge according to claim 34, further comprising:

a third groove arranged between the first and second groove in the third direction, wherein a length of the third groove in the first direction is larger than the length of the second groove in the first direction.

36. The ink cartridge according to claim 35, wherein the first, third and second grooves are arranged in this order in the third direction away from the ink supply port.

37. The ink cartridge according to claim 34, further comprising:

a retaining member disposed opposite from the first and second grooves with respect to the ink supply port in the third direction; and a memory device disposed opposite from the first and second grooves with respect to the ink supply port in the third direction.

38. The ink cartridge according to claim 31, wherein shapes of the first and second grooves represent a kind of the ink stored in the container.

39. The ink cartridge according to claim 31, further comprising:

a block attached to the container along a first side surface of the container, wherein the first and second grooves are at least partly defined by the block;

a slit that is formed in the container and that extends parallel to the first direction, wherein the slit is closer to the ink supply port than to the first and second grooves in a third direction perpendicular to the first and second directions;

a retaining member disposed on a second side surface of the container opposite from the first side surface in the third direction; and a memory device disposed on the second side surface.

40. The ink cartridge according to claim 39, wherein the first side surface is parallel to the first and second directions.

* * * * *

UNITED STATES PATENT AND TRADEMARK OFFICE

CERTIFICATE OF CORRECTION

PATENT NO. : 6,722,762 B2
DATED : April 20, 2004
INVENTOR(S) : Hisashi Miyazawa et al.

It is certified that error appears in the above-identified patent and that said Letters Patent is hereby corrected as shown below:

Column 2,
Line 47, change “invention” to -- invention. --.

Column 4,
Line 49, change “The flowpassage” to -- The flow passage --.
Line 49, change “air flowpassage” to -- air flow passage --.
Line 64, change “24*a*extends” to -- 24*a* extends --.

Column 5,
Line 7, change “The flowpassage” to -- The flow passage --.

Column 7,
Line 40, change “maybe” to -- may be --.
Line 64, change “As lit” to -- A slit --.

Column 8,
Line 24, change “204*d*” to -- 204 --.

Column 10,
Line 57, change “72A” to -- 72. A --.

Column 11,
Line 31, change “carriage. 200.” to -- carriage 200. --.
Line 34, change “142*a*and” to -- 142*a* and --.

Column 14,
Line 32, change “18” to -- 18 --.

Column 16,
Line 43, change “the,” to -- the --.
Line 45, change “pieces That” to -- pieces. That --.

UNITED STATES PATENT AND TRADEMARK OFFICE

CERTIFICATE OF CORRECTION

PATENT NO. : 6,722,762 B2
DATED : April 20, 2004
INVENTOR(S) : Hisashi Miyazawa et al.

It is certified that error appears in the above-identified patent and that said Letters Patent is hereby corrected as shown below:

Column 18,
Line 23, change “claim 9” to -- claim 10 --.

Column 20,
Line 36, change “claim 24” to -- claim 26 --.
Line 62, change “axe” to -- are --.

Column 21,
Line 9, change “farther” to -- further --.
Line 14, change “fanned” to -- formed --.

Signed and Sealed this

Fourteenth Day of September, 2004

JON W. DUDAS
*Director of the United States Patent and Trademark Office*